US010500122B2

(12) United States Patent
Aryananda et al.

(10) Patent No.: US 10,500,122 B2
(45) Date of Patent: Dec. 10, 2019

(54) APPARATUS FOR GAIT TRAINING

(71) Applicant: Hocoma AG, Volketswil (CH)

(72) Inventors: Lijin Aryananda, Zug (CH); Rainer Bucher, Wettswil a.A. (CH); Patrizia Hählen, Bern (CH); Lucian Marius Cucu, Epalinges (CH)

(73) Assignee: Hocoma AG, Volketwil (CH)

( * ) Notice: Subject to any disclaimer, the term of this patent is extended or adjusted under 35 U.S.C. 154(b) by 199 days.

(21) Appl. No.: 15/324,476

(22) PCT Filed: Jul. 7, 2015

(86) PCT No.: PCT/EP2015/065440
§ 371 (c)(1),
(2) Date: Jan. 6, 2017

(87) PCT Pub. No.: WO2016/005367
PCT Pub. Date: Jan. 14, 2016

(65) Prior Publication Data

US 2017/0165145 A1 Jun. 15, 2017

(30) Foreign Application Priority Data

Jul. 9, 2014 (EP) ..... 14176412

(51) Int. Cl.
*A61H 3/00* (2006.01)
*A61H 1/02* (2006.01)
(Continued)

(52) U.S. Cl.
CPC ..... *A61H 3/008* (2013.01); *A61G 7/109* (2013.01); *A61G 7/1015* (2013.01);
(Continued)

(58) Field of Classification Search
CPC ..... A63B 69/0064; A63B 7/00; A61H 3/008; A61H 1/0218
See application file for complete search history.

(56) References Cited

U.S. PATENT DOCUMENTS 953,962 A * 4/1910 Lane ..... A61G 7/1046 190/12 R
5,174,590 A * 12/1992 Kerley ..... A61H 3/008 280/1.5
(Continued)

FOREIGN PATENT DOCUMENTS

DE 102008029564 A1 12/2009
EP 0241096 A2 10/1987
(Continued)

*Primary Examiner* — Nyca T Nguyen
(74) *Attorney, Agent, or Firm* — The Webb Law Firm

(57) ABSTRACT

An apparatus (100) for gait training has a movable base (200) comprising at least one drive unit (210) for moving the movable base, an arm arrangement (300) extending from the movable base, a weight support system (400) to enable a person to be at least partially suspended from above via said arm arrangement, a movement detector to detect a movement of the person and a control unit adapted to control said drive unit(s) in response to a movement of the person detected by the movement detector such that the movable base follows the person in a predetermined distance range and in a predetermined angular range with respect to a movement direction of the person.

15 Claims, 18 Drawing Sheets

(51) Int. Cl.
*A61H 3/04* (2006.01)
*A63B 21/00* (2006.01)
*A61G 7/10* (2006.01)

(52) U.S. Cl.
CPC ..... *A61G 7/1046* (2013.01); *A61G 7/1048* (2013.01); *A61G 7/1051* (2013.01); *A61G 7/1061* (2013.01); *A61G 7/1067* (2013.01); *A61G 7/1086* (2013.01); *A61H 1/0229* (2013.01); *A61H 3/04* (2013.01); *A63B 21/4027* (2015.10); *A61G 2203/36* (2013.01); *A61H 2003/043* (2013.01); *A61H 2201/0192* (2013.01); *A61H 2201/123* (2013.01); *A61H 2201/1215* (2013.01); *A61H 2201/1246* (2013.01); *A61H 2201/149* (2013.01); *A61H 2201/1619* (2013.01); *A61H 2201/1628* (2013.01); *A61H 2201/1652* (2013.01); *A61H 2201/5058* (2013.01); *A61H 2201/5064* (2013.01); *A61H 2201/5069* (2013.01)

(56) References Cited

U.S. PATENT DOCUMENTS 5,569,129 A * 10/1996 Seif-Naraghi ..... A61G 7/1019 135/67
6,092,247 A * 7/2000 Wilson ..... A61G 7/1011 5/81.1 R
6,821,233 B1 11/2004 Colombo et al.
7,827,630 B2 * 11/2010 Bostelman ..... A61G 7/1007 5/83.1
8,192,331 B2 6/2012 Colombo et al.
2005/0101448 A1 * 5/2005 He ..... A61H 1/0237 482/54
2008/0070757 A1 * 3/2008 Albert ..... A63B 69/0064 482/54
2009/0298653 A1 * 12/2009 Rodetsky ..... A61H 3/04 482/69
2014/0100491 A1 * 4/2014 Hu ..... A61H 3/008 601/27
2014/0222177 A1 * 8/2014 Thurman ..... G09B 19/0038 700/92
2014/0265199 A1 * 9/2014 Bagheri ..... A61G 5/1002 280/87.041
2017/0216126 A1 * 8/2017 Matjacic ..... A63B 69/0064

FOREIGN PATENT DOCUMENTS

EP 1908442 A1 4/2008
JP 2009195636 A 9/2009
WO 0028927 A1 5/2000
WO 2012107700 A2 8/2012
WO 2014081400 A2 5/2014

* cited by examiner

APPARATUS FOR GAIT TRAINING

CROSS-REFERENCE TO RELATED APPLICATIONS

This application is the United States national phase of International Application No. PCT/EP2015/065440 filed Jul. 7, 2015, and claims priority to European Patent Application No. 14176412.6 filed Jul. 9, 2014, the disclosures of which are hereby incorporated in their entirety by reference.

BACKGROUND OF THE INVENTION

Field of the Invention

The present invention relates to an apparatus for gait training having a movable base comprising at least one drive unit for moving the movable base, an arm arrangement extending from the movable base, a weight support system to enable a person to be at least partially suspended from above via said arm arrangement, a movement detector to detect a movement of the person and a control adapted unit to control said drive unit(s) in response to a movement of the person detected by the movement detector such that the movable base follows the person in a predetermined distance range and in a predetermined angular range with respect to a movement direction of the person.

Description of Related Art

WO 2012/107700 discloses an apparatus for gait training having a movable base comprising a drive unit for moving the movable base, an arm arrangement extending from the movable base, a weight support system to enable a person to be at least partially suspended from above via said arm arrangement, a movement detector to detect a movement of the person and a control unit adapted to control said drive unit in response to a movement of the person detected by the movement detector such that the movable base follows the person in a predetermined distance range and in a predetermined angular range with respect to a movement direction of the person.

Therefore mechanical and control features are known from the prior art for keeping the apparatus for gait training at a predetermined angle and distance in respect of the patient.

The prior art device is somehow limited in the detection of any change of direction the patient may perform.

SUMMARY OF THE INVENTION

Therefore it is an object of the present invention to provide an apparatus with the features of the preamble of claim 1 with an improved detection of change of direction of a moving patient.

A further object of the invention is related to the problem that prior art apparatuses are quite high and cannot be easily used to move from one room to another in buildings.

Furthermore, it is an object of the invention to provide a more versatile use of the apparatus, i.e. to provide the use as a patient lifter of lifting accessories, whereas prior art devices are pure gait training apparatuses and cannot be used to lift a patient from a sitting or lying position in a bed or chair to a standing position.

In the context of the present invention the support of the user's weight can also be at least partial. It can also be Zero or almost Zero during normal walking activities. Then the harness attachment is a safety support if the user would trip, stumble and/or fall; in such a case the weight support will raise until the entire body weight.

On the other side, it is possible to use the apparatus as patient lift or mobile crane as shown in EP 241 096, supporting the whole weight.

The apparatus according to the invention can also be used at a fixed place. Then the mobile base is a fixed base and said drive unit(s) are adapted to drive a treadmill integrated to the fixed base. In other words, the features of the harness attachment to detect the turning intention, the telescopic height adjustment and other features can be used in connection with a fixed base, especially, when the treadmill comprises two separate treadmill belts for each foot, so that different velocities of the belt parts can simulate a turning movement. Then at least one drive unit is integrated within the fixed base for moving one or two belts of the treadmill. The control unit is adapted to control the drive unit(s) in response to a movement of the person detected by the movement detector such that the belt(s) of the treadmill are moving in a relative movement in view of the walking person in a predetermined distance range and in a predetermined angular range with respect to a movement direction of the person that the person on the belt remains positioned essentially oriented uprightly on the belt(s) within the harness being in the vicinity below the side arms of the arm arrangement. Having a user walking with a mobile base is similar to a user walking on a treadmill being a fixed base, which is mobile in the sense of the invention through the walking pattern auf the user walking on a moving ground provided by the treadmill. The advantages of the directional support is given, if not only one but two treadmill belts are provided, one for each foot of the user.

Telescopic height adjustment is related to any extendible, extensile, extractable, pull-out adjustment, realized e.g. by linear drives or pistons and plunger/cylinder combinations, cam controlled devices to provide a height adjustment function.

Further embodiments of the invention are laid down in the dependent claims.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DETAILED DESCRIPTION OF THE INVENTION

Figure 1:
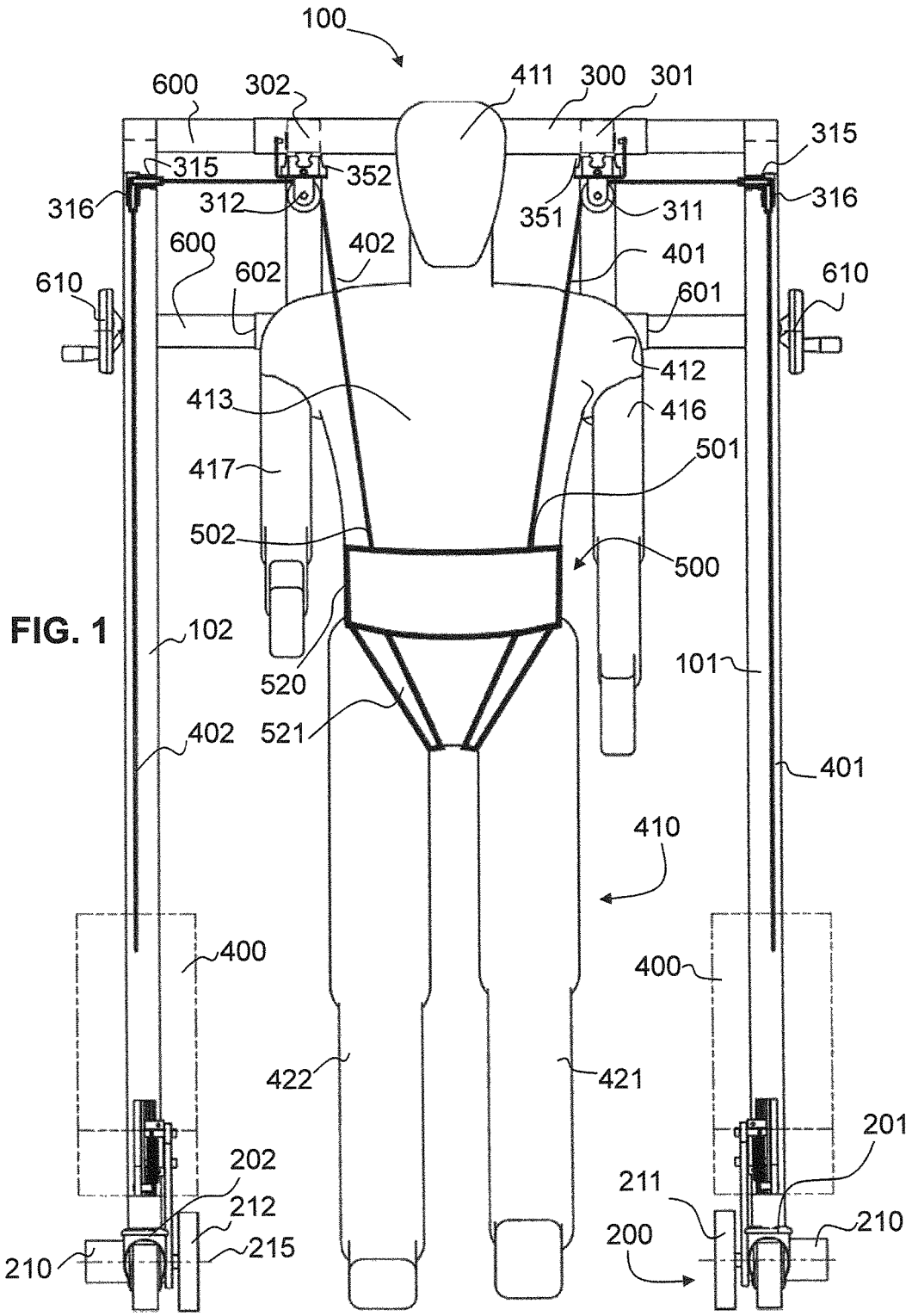
FIG. 1 shows a schematic front view of main elements of an apparatus for gait training according to an embodiment of the invention with a person attached to the apparatus.

FIG. 1 shows a schematic front view of an apparatus 100 for gait training according to an embodiment of the invention with a person 410 attached to the apparatus 100. The apparatus 100 has a frame comprising a left column 101 and a right column 102 (left and right in relation to the person using the apparatus) connected together in the upper part of the frame through two crossbeams 600 connecting the two columns 101 and 102 in a predetermined distance one from the other creating the space for accommodating the person 410.

It is preferred that the crossbeam 600 arrangement can be adjusted in its width through telescoping connections 601 and 602 provided in the upper and lower crossbeams 600. The outer elements of the telescoping connections are arranged in the center beam part. It is possible to provide turning adjustment wheels 610 acting on a gear inside the hollow crossbeams 600 to adjust the width of the arrangement. Preferably, the length of the crossbeam arrangement 600 between the telescoping point 601 and 602 is adjustable so that the shoulders 412 of a person positioned in the apparatus are positioned below the side arms 301 and 302 as will be explained below.

It is an advantage of the device that the head 411 of the person 410 can be positioned just in front of the crossbeams 600 so that the head 411 may extend beyond the upper part of the apparatus 100 as shown in FIG. 1.

Figure 2:
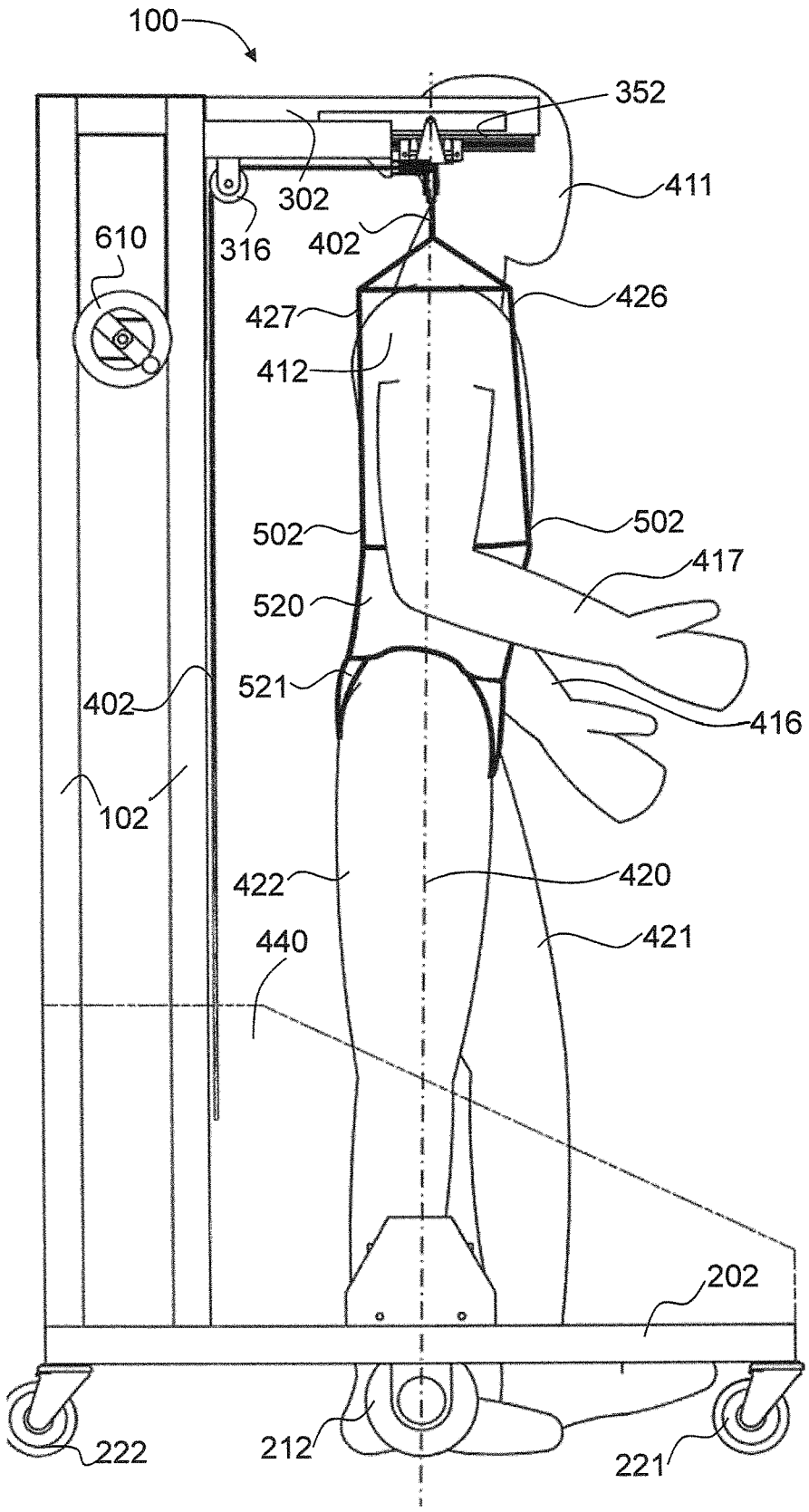
FIG. 2 shows a schematic side view of the apparatus of FIG. 1.

FIG. 2 shows a schematic side view of the apparatus of FIG. 1 with the elements used to provide the left base 201 and the right base 202 of the apparatus 100. Each base 201 and 202 comprises a horizontally arranged beam. At the free ends of the beam are attached a front support wheel 221 and a back support wheel 222. They can be oriented in the direction of the beam or they can be attached to as turn when the base is pivoted. The two parallel arranged elements provide a stable apparatus 100.

Two drive units 210 are attached to the left base 201 and right base 202, respectively driving a left driven wheel 211 and a right driven wheel 212 provided on the same horizontal axis 215. The horizontal axis 215 of the driven wheels 211 and 212 is preferably located in the frontal plane 420 of the person 410 attached in the harness 500 of apparatus 100. In other words, the center of gravity of the person 410 is essentially in or near the plane mainly crossing axis 215. The columns 101 and 102 are provided behind said frontal plane 420 seen on FIG. 2, i.e. behind the driven wheels 211 and 212 so that they are not in the field of vision of the person 410. However, the weight support system 400 or weight relief mechanism is preferably provided in the vicinity of the base elements 201 and 202 to achieve a stable configuration with a low center of gravity.

The crossbeam 600 further comprises an arm arrangement 300 with a left side arm 301 and a right side arm 302 extending in parallel to the left base 201 and right base 202, respectively. In other words, they are oriented essentially perpendicular to the crossbeams 600. The arm arrangement 300 is attached to the upper of the two crossbeam arrangements 600. Of course, it would also be possible to only provide one crossbeam arrangement.

Pulleys 311 and 312 are attached to guiding rails 351 and 352 which are provided below arms 301 and 302. The guiding rails can be inter alia gliding rails. The axes of pulley 311 and 312 are oriented in parallel and below the direction of movement provided by the guiding rails 351 and 352. Pulleys 311 and 312 are positioned above the shoulders 412 of a person 410 using the apparatus. The horizontal distance between the arms 301 and 302 and therefore the horizontal distance between the pulleys 311 and 312 is such that the head 411 of the person 410 can be positioned between the arms 301, 302 in a way being comfortable for said person 410.

The guiding rails 351 and 352 are adapted to glide forward and backward upon any force exerted in this direction upon either pulley 311 or 312. These pulleys 311 and 312 are wheels mounted to turn around said horizontal axis connected to the guiding rails 351 and 352 wherein the axis is oriented in parallel to the side arms 301 or 302 respectively. Therefore, a left rope 401 and right rope 402 (left and right in relation to the person) can be redirected by set pulleys 311 and 312 from a horizontal portion of the rope in parallel to the crossbeams 600 into an essentially downward direction to be attached at points 501 and 502 to the harness 500. The ropes 401 and 402 are slightly inclined one to the other in the frontal plane of the person 410 which is due to the fact that the attachment points 501 and 502 are at the pelvis part 520 of the harness 500. Additionally they are provided in front and in the back of the person 410. In other words, ropes 401 and 402 are separated into two rope parts 426 and 427 to be attached in front and in the back of the harness 500. For that the rope parts 426 and 427 are maintained in a distance by rod 428. The harness 500 as pelvis part comprises crotch straps 521 connecting the front part of the harness 500 to the back part.

The guiding rails 351 and 352 can use gliding or sliding rails or linear bearings. In further embodiments (not shown in the drawings) the guiding rails 351 and 352 can be curved in order to modify the amount of force required to act on the pulleys 311 and 312 for moving the pulleys 311 and 312 on the guiding rails 351 and 352. This can be achieved preferably that the guiding rails are provided in the plane of the beams 301 and 302 curved according to a circular track wherein the center of the track is the nearest pulley 315. Then, when turning right the rope diverted at the guiding rail 352 follows directly the curve of the guiding rail and there is no difference in length for this rope part, since the distance between pulley 315 and the portion of the guiding rail 352 is constant. On the other hand, when turning right, the opposite guiding rail 351 guiding the rope to pulley 315 on the left side of the person is curved in the opposite direction and therefore needs more rope.

It is also possible to provide the guiding rails 351 and 352 in the plane of the beams 301 and 302 curved according to a circular track wherein the center of the track is the pulley 315 opposite to the guiding rail, in other words, the free ends of the guiding rails 351 and 352 are nearer one to the other than the middle portions. Then the rope on the opposite side remains at the same length when turning, whereas the rope on the turning side needs a prolongation.

Rope 401 and rope 402 are redirected by pulley 311, 312 into a horizontal direction towards the left column 101 and the right column 102 to be redirected with a combination of further pulleys 315 and 316 into a rope part oriented in parallel to the columns 101 and 102 and ending in and attached to a weight support system 400.

Such a weight support system 400 or weight relief system can be of any kind known in the art as e.g. the electronic system disclosed by the applicant in EP 1 586 291 A1 or the mechanical compensation scheme as developed by the applicant in EP 1 908 442 A1 or it can also be a simple spring attached to the base 201 or base 202.

The harness 500 with pelvis part 520 and e.g. four attachment points 501, 502 for rope sections 426 and 427 being combined into a left rope 401 and right rope 402 just below the pulleys 311 and 312 allows for a secure positioning of the person 410 in the apparatus with its frontal plane above the axis 215 of the driven wheels.

As mentioned FIG. 2 shows a schematic side view of the apparatus of FIG. 1 with the frontal plane 420 as a dashed line connecting the attachment portion of pulleys 311 and 312 in a vertical orientation to the ground crossing the axis 215 of the driving wheels 211 and 212.

The front part 426 of the rope 402 as well as the back part 427 of the rope 402 are attached at the front and back attachment points 502 at the pelvis part 520 of harness 500 wherein the distance between the rope parts 426 and 427 are maintained between the attachments point and the shoulder region 412 of the person by distance rods 428 providing the lower base of the joining triangle for the rope parts 426 and 427 to the unique right body part rope 402 as shown in FIG. 2. Of course, the left part rope 401 comprises the same elements on the other side of the head 411 of the person 410. When the person 410 strives to walk forward and as such is leaving the plane 420 above axis 215 sensors detect this movement and via a control unit 900 give control signals to the drive unit 210 which then drive wheels 211 and 212 to move the apparatus 100 forward. This is similar for walking backwards and turning in place. Since support wheels 221 and 222 are provided in front and in the back of the driven wheel 211 and 212 preferably at the front and back free ends of the base 201 and 202, apparatus 100 can be displaced according to the movement of the person with the center of gravity of the person always in the vicinity of the axis 215.

Sensors detecting the intended movement of the person can be inter alia sensors provided at the guiding rails 351 and 352 detecting the position of the pulley attachment of pulleys 311 and 312, respectively. If e.g. there would be no guiding rails 351 and 352 but pulleys 311 and 312 could be inclined to follow an inclination of rope portions 401 or 402 towards the bifurcation into sections 426 and 427, then sensors could detect this inclination of rope or pulleys.

When the person 410 advances then the torso of the person 410 will advance before the former frontal plane 420 and both pulleys 311 and 312 will move forward on the guiding rails 351 and 352.

When the person 410 is trying to make a turn, e.g. turning right, the pelvis is turning in the way that the left part of the pelvis above the left leg 421 is advancing further than the right part. This is immediately transferred to the harness 520, especially since crotch straps 521 connect the leg position to the pelvis position, and via the rope parts 426 and 427 as well as the ropes 401 and 402 to the attachment portions at the arms 300. Then, pulley 311 is gliding forward on arm 301 through the guiding rail 351 whereas pulley 312 is moving backward on its guiding rail 352, or forward by a smaller amplitude. This movement is detected by the sensors and translated into drive signals for drive unit 210 so that driven wheel 211 is moving faster whereas driving wheel 212 is moving slower or even stopping or even moving backward enabling a turning of the whole apparatus 100, optionally while the person 410 is advancing at the same time.

The separation of rope 402 into sections 426 and 427 allows for a free swinging movement of arms 416 and 417 while walking.

Figure 3:
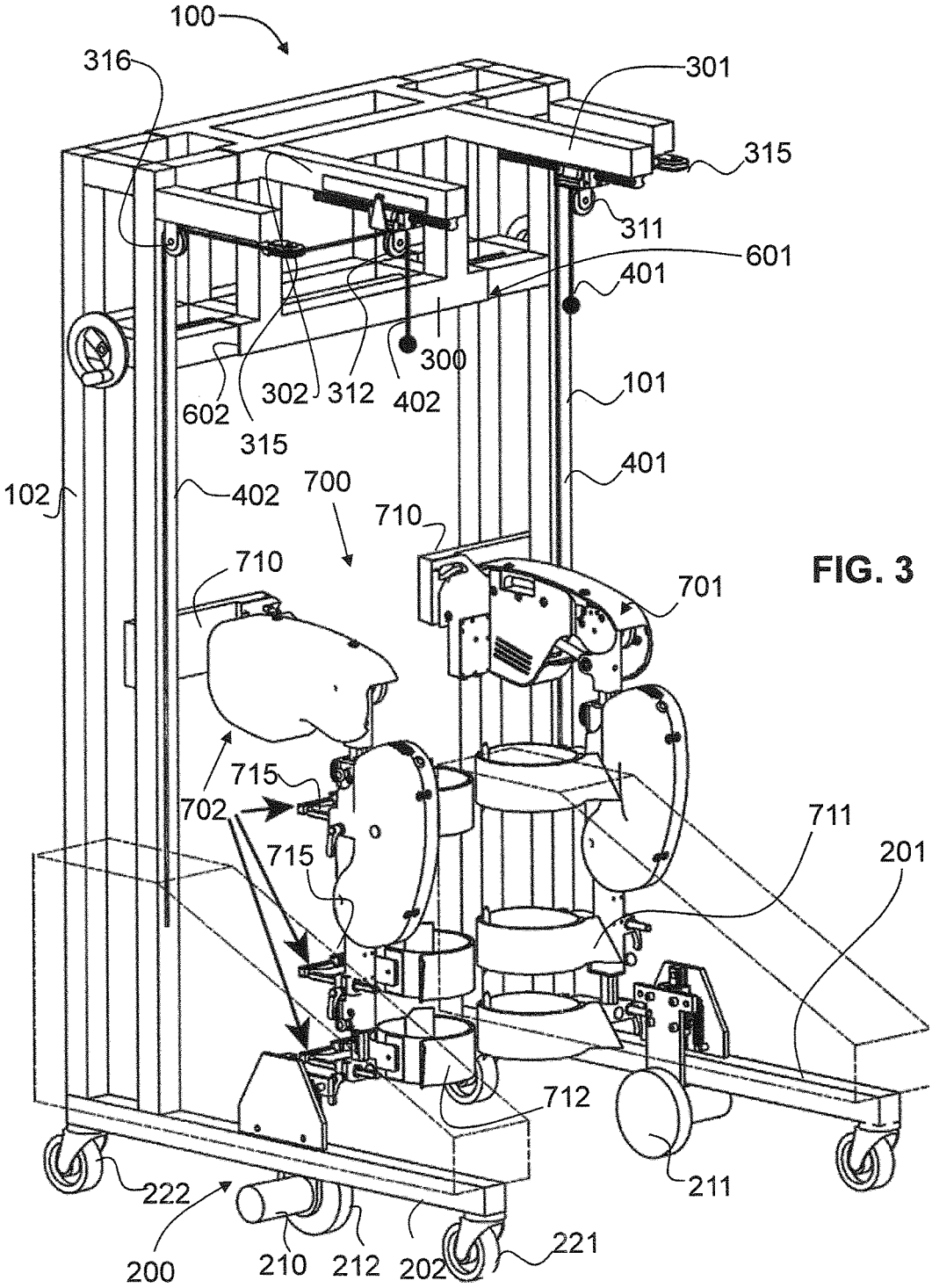
FIG. 3 shows a schematic perspective view of main elements of an apparatus for gait training according to a further embodiment of the invention with an orthosis as part of the apparatus.
Figure 5:
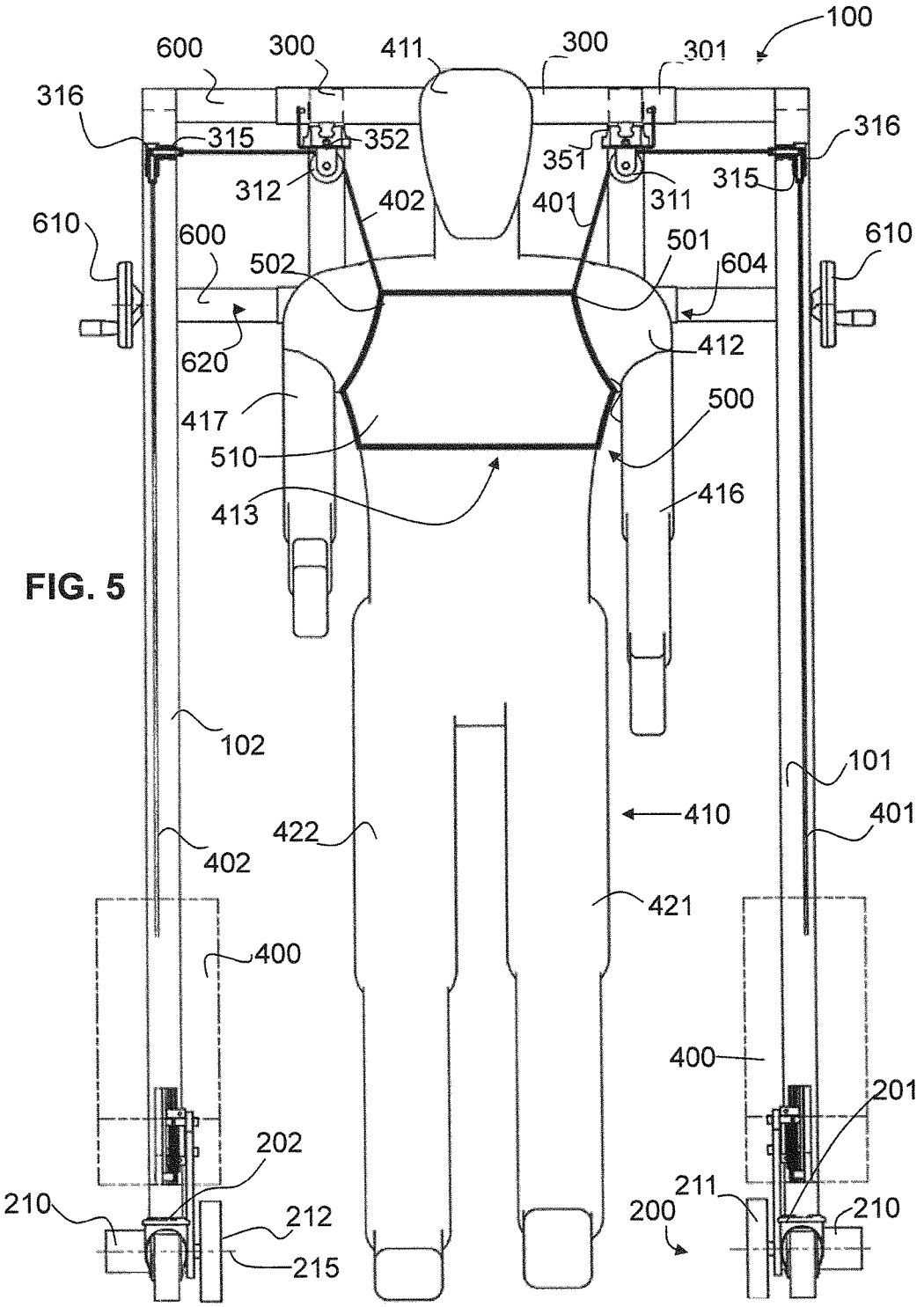
FIG. 5 shows a schematic front view of main elements of an apparatus for gait training according to another embodiment of the invention with a person attached to the apparatus with a different harness in comparison to FIG. 1.

FIG. 3 shows a schematic perspective view of main elements of an apparatus for gait training according to a further embodiment of the invention with a leg orthosis 700 as part of the apparatus. The ropes 401 and 402 are shown but the person to be attached within an harness is omitted to better show the leg orthosis 700 attached at leg frame parts 710 attached at the columns 101 and 102. The leg orthosis can be described as shown in FIG. 5 of WO 00/28927 A1 of the applicant. In the context of the present invention it is important that the left and right orthosis 701 and 702 comprise cuffs 711 and 712 which can be displaced in the direction of axis 215. In other words, cuffs 711 and 712 are attached on the leg orthosis parts to support the movement of the leg 421 or 422 of a person 410 in the sagittal plane but the cuffs 711 and 712 are free to be displaced in the transverse direction. This can be achieved through mounting the cuffs 711 and 712 on hollow sleeves 716 which are gliding on inner rods 715 attached to the relevant portion of the leg orthosis. Inner rods 715 are oriented in parallel to axis 215 and perpendicular to plane 420. When a person 410 in the apparatus 100 tries to turn right and thus advancing his left leg while turning his pelvis to the right the left leg 421 will move inwards and thus the three cuffs 711 on the sleeves 716 will move on the inner rods 715 away from orthosis 701 towards the opposite side.

In another embodiment of the invention, cuffs 711 and 712 may be mounted on guiding rails oriented in parallel to axis 215.

Sensors detect the transverse movement of one or more cuffs and via control unit 900 give control signals to the drive unit 210 which then drive wheels 211 and 212 to move the apparatus 100. Linear potentiometers mounted on or near the sleeves 716 or guiding rails can be used in an embodiment of the invention. Alternatively, linear sensors similar to linear sensors 801 and 802 mentioned below or ultrasonic distance sensors can be used in further embodiments of the invention for detecting the lateral movement of the cuffs.

Figure 4:
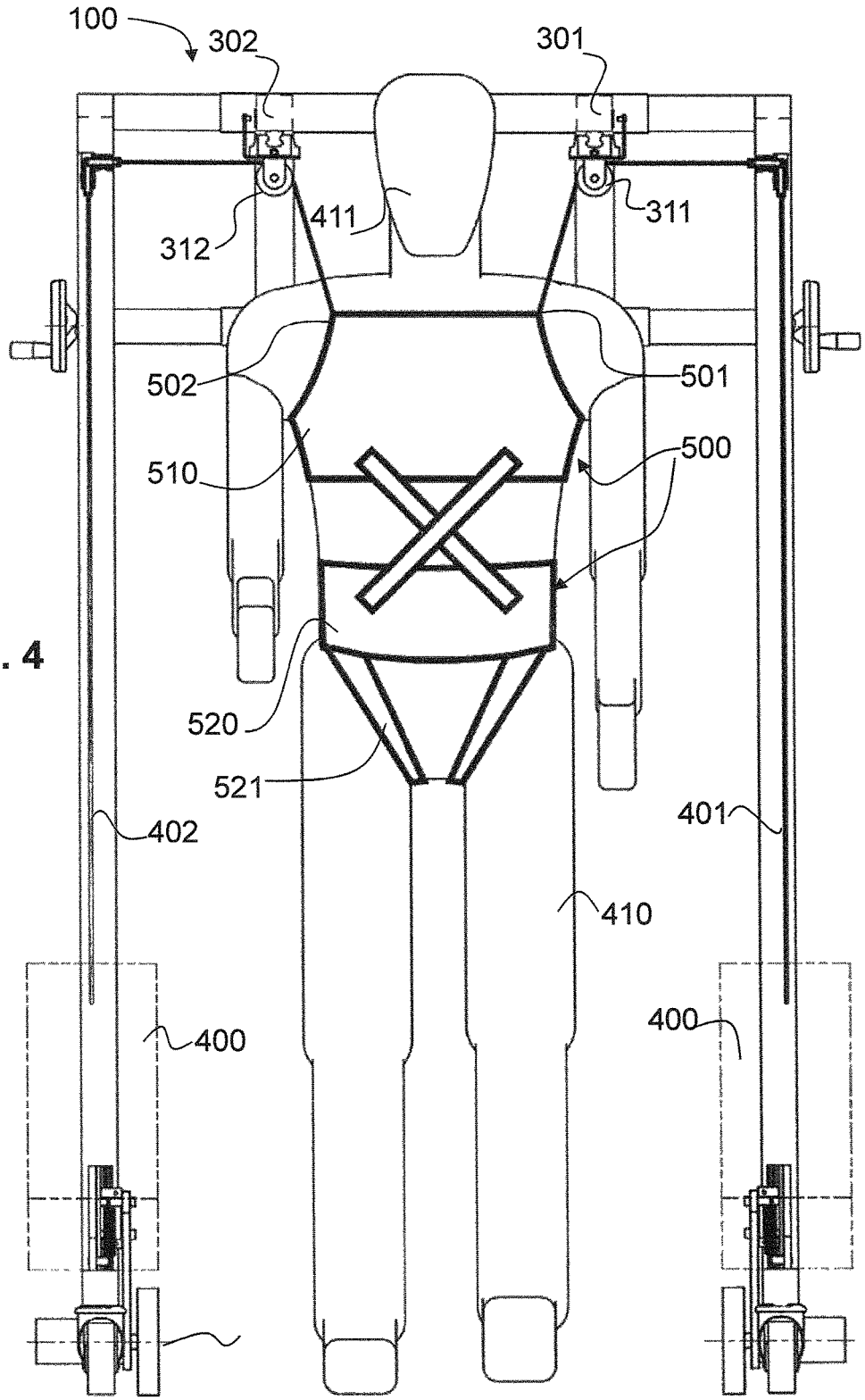
FIG. 4 shows a schematic front view of main elements of an apparatus for gait training according to another embodiment of the invention with a person attached to the apparatus with a different harness in comparison to FIG. 1.

FIG. 4 shows a schematic front view of main elements of an apparatus 100 for gait training according to another embodiment of the invention with a person 410 attached to the apparatus 100 with a different harness 500 in comparison to FIG. 1. All similar or identical elements have received similar or identical reference numerals throughout the specification. The frame or apparatus 100 of FIG. 1 is identical to the frame of FIG. 1. Harness 500 is here a two part harness with a torso part or upper part 510 and a lower part or pelvis part 520, the latter having the crotch straps 521. The upper part 510 and the pelvis part 520 are connected with stretch sensors 531 and 532. These are or can be provided in the front and the back part of the harness 500. They can be used in addition or replacing the sensors in connection with the guiding rails 351 and 352. When the person 410 is advancing the stretch sensors in front of the person become shorter and the stretch sensors in the back of the person become longer. When the person 410 is turning right, stretch sensor 531 in front of the person becomes longer and stretch sensor 532 in the front of the person becomes shorter. These detected differences can be translated by a control unit in control and drive signals for the drive units 210 to be transmitted to wheels 211 and 212.

FIG. 5 shows a schematic front view of main elements of an apparatus 100 for gait training according to another embodiment of the invention with a person 410 attached to the apparatus with a different harness 500 in comparison to FIG. 1. Here only a torso part 510 is provided so that the detection of movement of the user is to be detected by the orientation and position of the ropes 401, 402. Of course it is also possible to detect the position of the harness portion 510 by optical methods, i.e. taking pictures of the person 410 in the harness 510 and derive the shoulder 412 and/or pelvis position.

Figure 6:
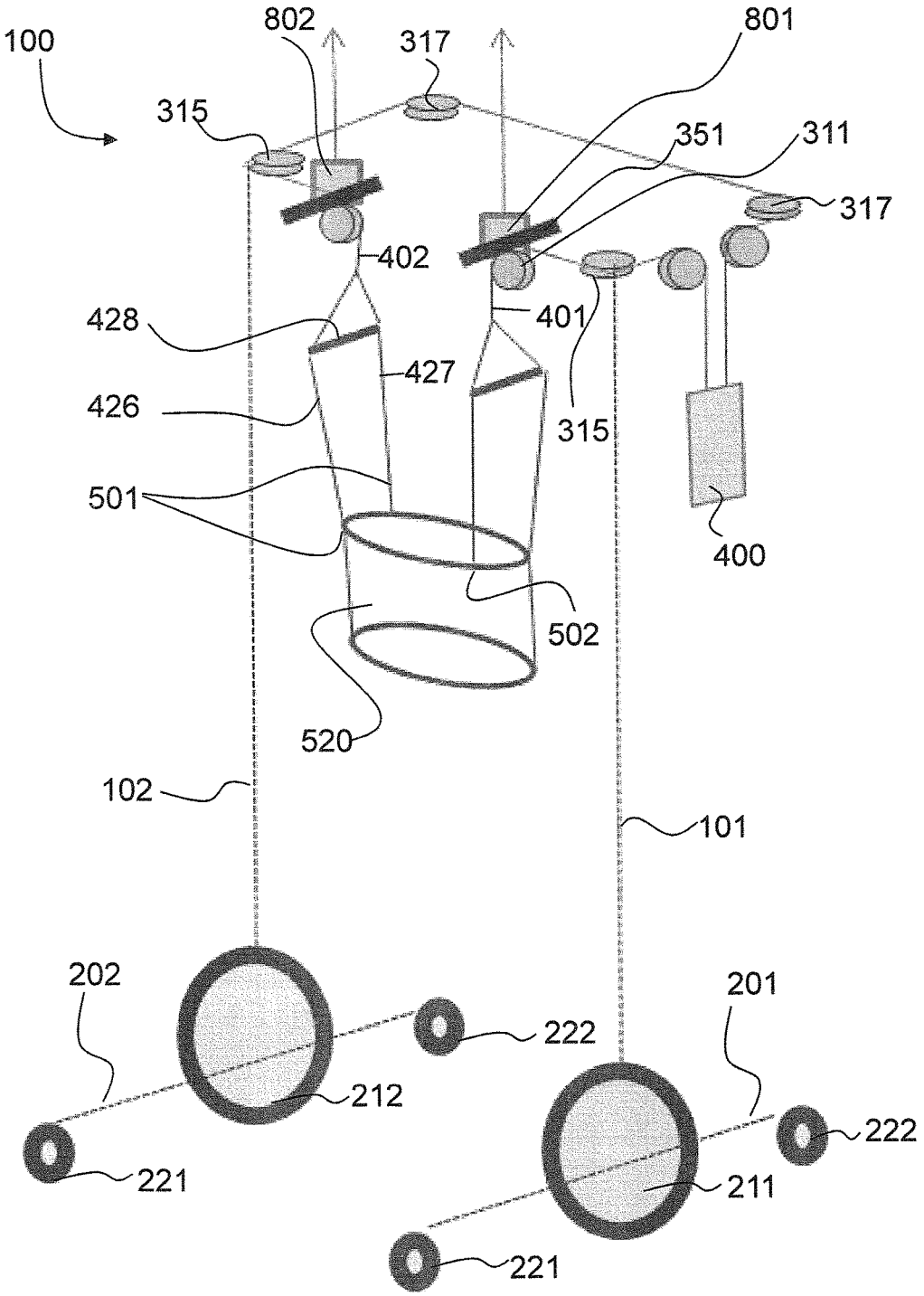
FIG. 6 shows a schematic diagram of an apparatus for gait training depicting an arrangement of the frame and ropes in connection with a weight relief mechanism according to an embodiment of the invention.

FIG. 6 shows a schematic diagram of an apparatus 100 for gait training depicting an arrangement of the frame and ropes in connection with one combined weight relief mechanism 400 according to an embodiment of the invention. Rope 401 is redirected over pulley 311 which is attached at rail 351. A linear sensor 801 detects the position of pulley 311 attachment on rail 351. It can also be an angular sensor relating to pulley 311. Linear sensor 802 is provided on the other side detecting the position of the rope in relation to the right pelvis portion of the person in the pelvis harness 520.

Here further pulleys 317 redirect one rope; here rope 402 to bring it in parallel to rope 401 to be introduced into the weight support system 400, which is provided on one single side of the apparatus 100.

Figure 7:
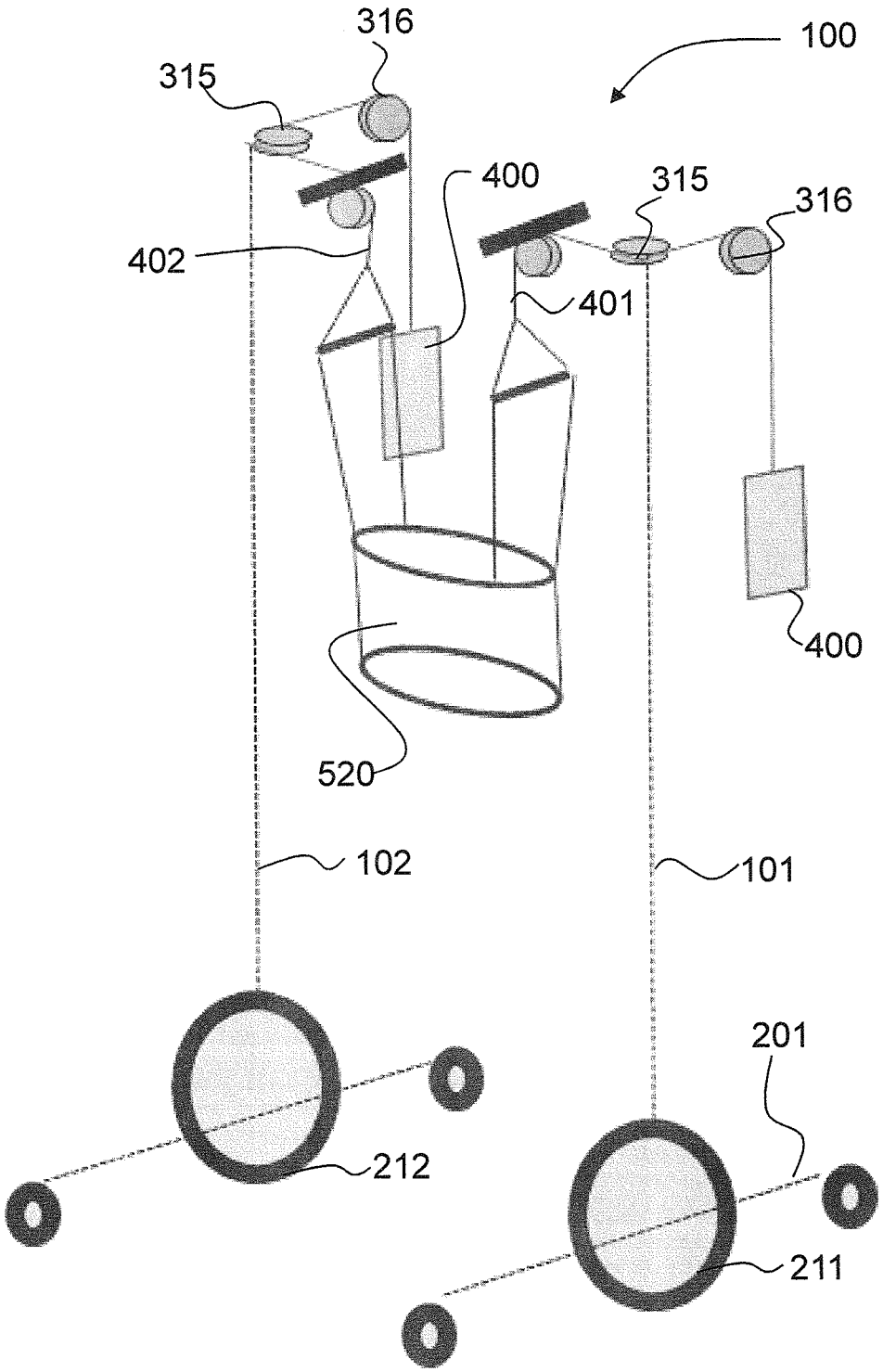
FIG. 7 shows a schematic diagram of an apparatus for gait training depicting an arrangement of the frame and ropes in connection with a weight relief mechanism according to FIG. 1.

FIG. 7 shows a schematic diagram of an apparatus 100 for gait training depicting an arrangement of the frame and ropes in connection with a weight relief mechanism 400 according to the embodiment according to FIG. 1.

Figure 8:
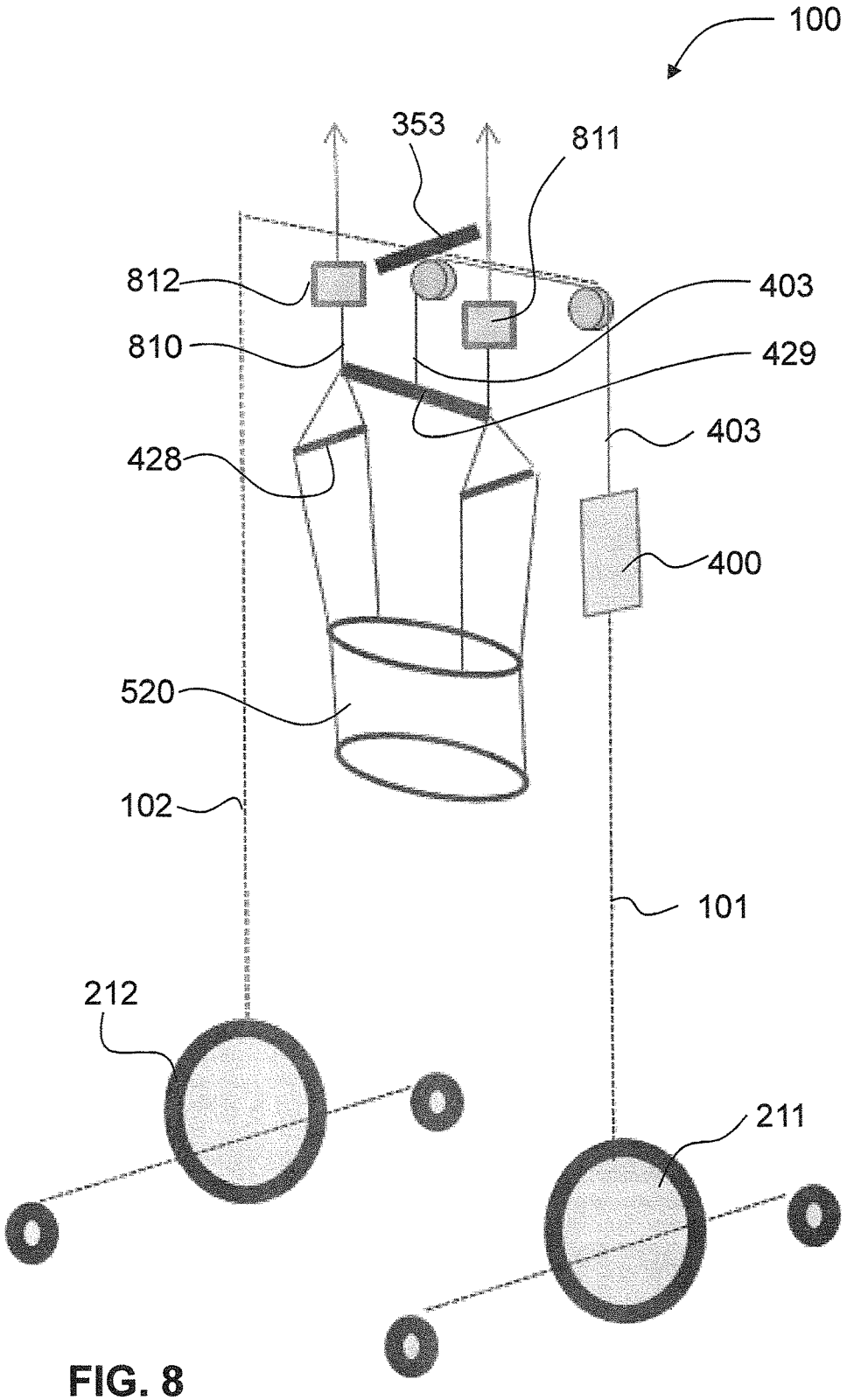
FIG. 8 shows a schematic diagram of an apparatus for gait training depicting an arrangement of the frame and ropes in connection with a weight relief mechanism according to a further embodiment of the invention.

FIG. 8 shows a schematic diagram of an apparatus 100 for gait training depicting an arrangement of the frame and ropes in connection with a weight relief mechanism 400 according to a further embodiment of the invention. Here, the ropes 401 and 402 are replaced by a single rope 403 attached to a transverse rod 429 then providing the attachment rope section 426, 427 for the pelvis harness 520. Then spring loaded angular sensors 811 and 812 are connected with wires 810 and are detecting the pelvis position. Here, the single rope 403 attached at a central guiding rail 353 is redirected towards the weight life mechanism 400. Of course the advantage of the possibility to have the head 411 of the person 410 determining the height of the apparatus 400 is lost within this embodiment.

Figure 9:
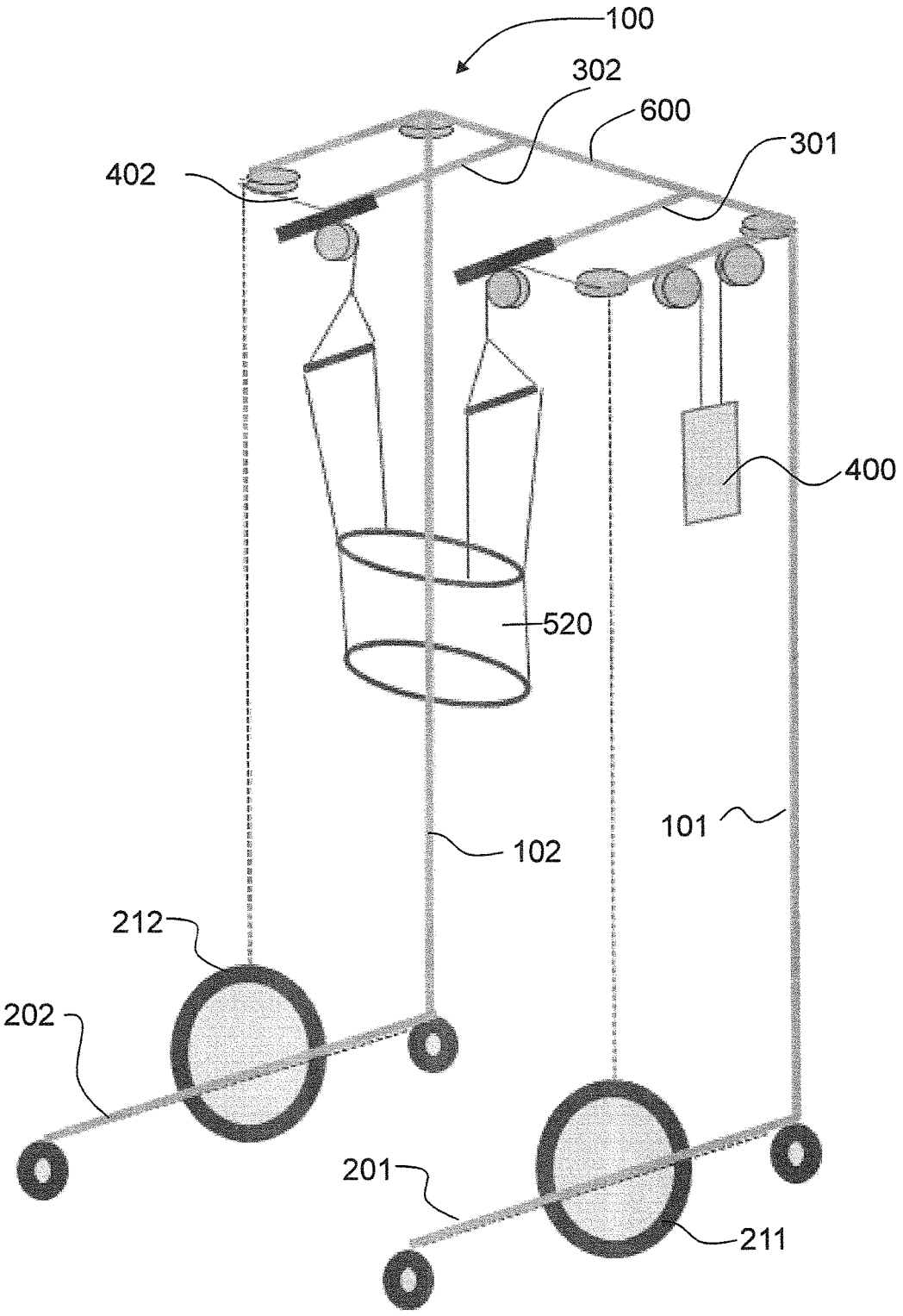
FIG. 9 shows a schematic diagram of an apparatus for gait training depicting an arrangement of the frame and ropes in connection with a weight relief mechanism according to a further embodiment of the invention.

FIG. 9 shows a schematic diagram of an apparatus 100 for gait training depicting an arrangement of the frame and ropes in connection with a weight relief mechanism 400 according to a further embodiment of the invention. Here, the frame parts are shown with one single crossbeam 600 and two parallel side arms 301 and 302, wherein the rope 402 is redirected via the crossbeam 600 as in FIG. 6 to the single weight relief mechanism 400.

Figure 10:
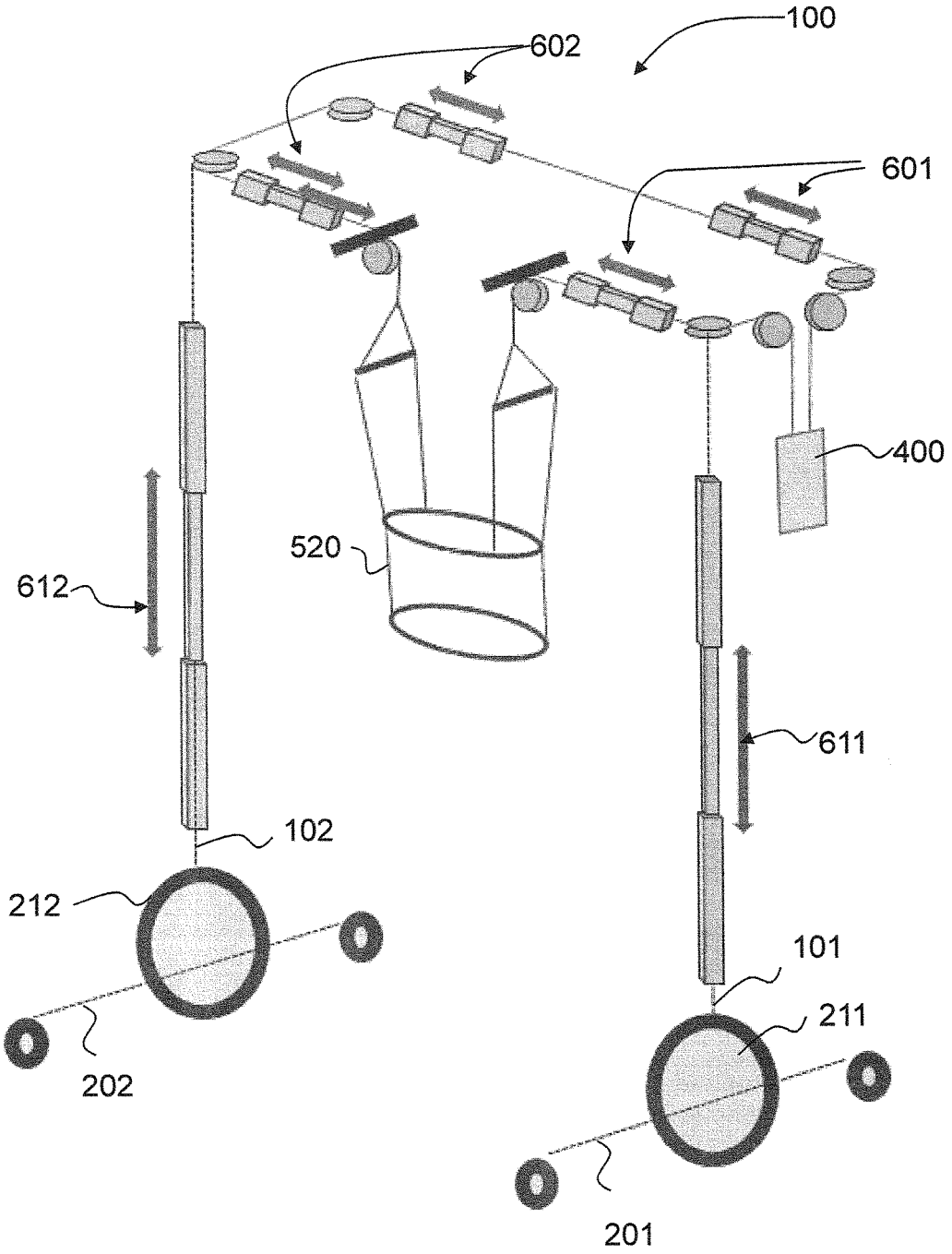
FIG. 10 shows a schematic diagram of an apparatus for gait training depicting an arrangement of the frame and ropes in connection with telescoping mechanisms for adjustment according to another embodiment of the invention.

FIG. 10 shows a schematic diagram of an apparatus 100 for gait training depicting an arrangement of the frame and ropes 401 and 402 in connection with telescoping mechanisms for adjustment according to another embodiment of the invention. Telescoping adjustments 601 and 602 are provided to allow approaching the bases 201 and 202 one towards the other while providing one single relief mechanism 400. Further vertical telescoping adjustments 611 and 612 are provided to allow an adjustment of the height of the apparatus 100. Said adjustment cannot only be provided to allow an adaptation of the apparatus to shorter or taller persons 401, but it can also be used in the context of a patient lift. Then the bases 201 and 201 are separated as far as possible to position the apparatus behind a bed or wheelchair. The adjustments 611 and 612 reduce the height to attach the harness 520 to the user. Then the adjustments 611 and 612 are lengthened to lift the person 520 from a sitting or lying position into a standing position. The wheelchair or bed is pushed away and the basis 201 and 202 are positioned closer one to the other to provide a stable apparatus 100 and the apparatus 100 is then adapted to pass through narrow doorways.

Figure 11:
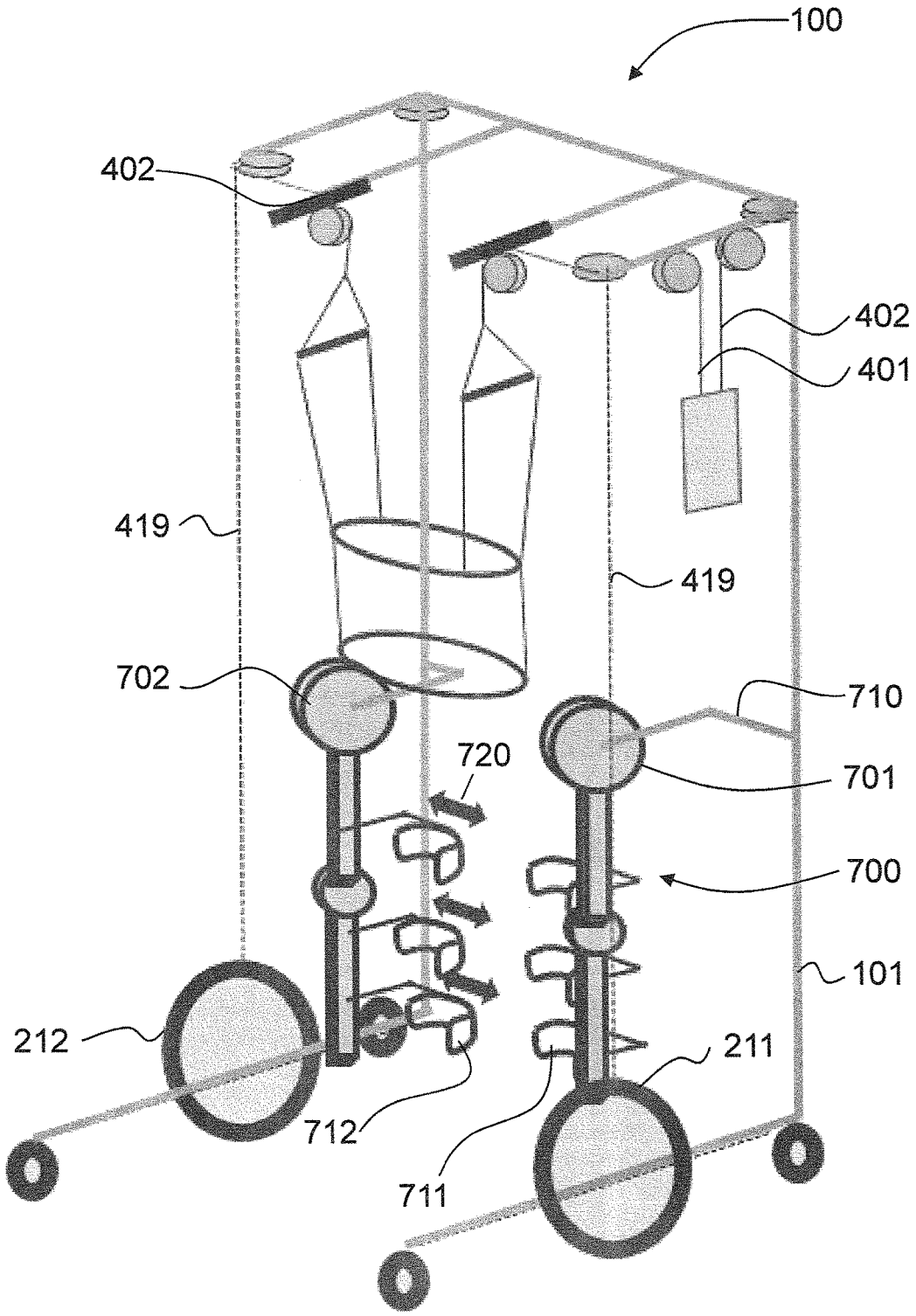
FIG. 11 shows a schematic diagram of an apparatus for gait training depicting an arrangement of the frame and ropes in connection with an integrated orthosis according to another embodiment of the invention.
Figure 19:
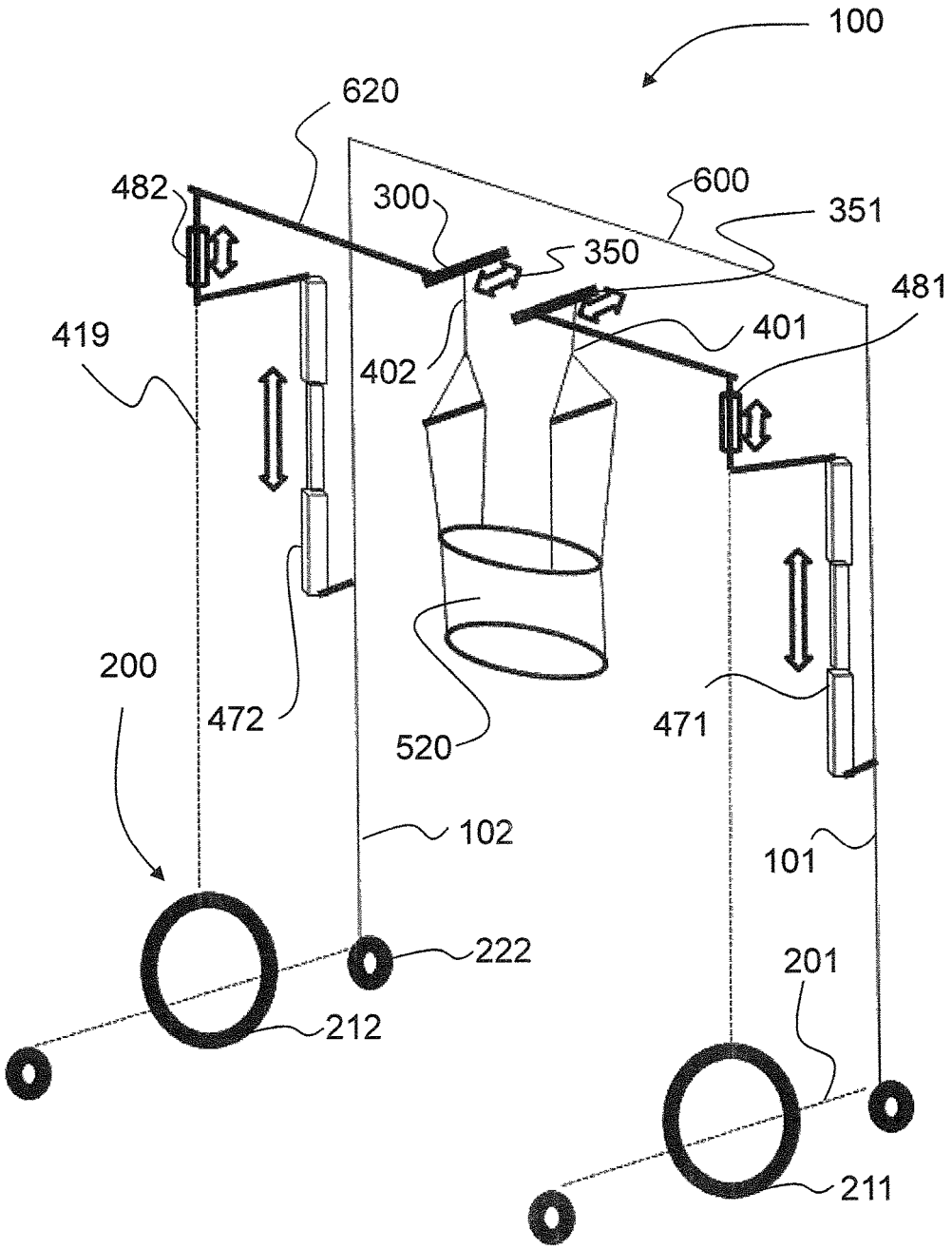
FIG. 19 shows a schematic diagram of an apparatus for gait training depicting an arrangement of a different fixed size frame and ropes in connection with a weight relief mechanism according to a further embodiment of the invention.

FIG. 11 shows a schematic diagram of an apparatus 100 for gait training depicting an arrangement of the frame and ropes in connection with an integrated orthosis 700 according to another embodiment of the invention. As mentioned in connection with FIG. 3 cuffs 711 and 712 can freely move in the direction of the double arrow 720 in parallel to axis 215 while the orthosis 700 provide a guiding of the person's legs 421 and 422 in the movement direction. Preferably orthosis 700 is mounted essentially in the frontal plane 420, which comprises the two vertical lines 419 as shown in FIG. 19. In other words, the legs of a user are essentially positioned between the driven wheels 211 and 212 in the frontal plane 420. Then any turning movement of the user is supported by the adjustable cuffs 711 and 712 and followed by subsequent movement of the wheels 211 and 212 to adapt the position of the frontal plane 420 in the new direction.

Figure 12:
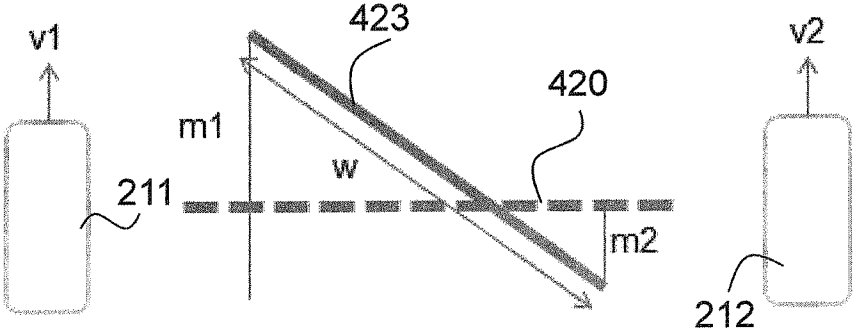
FIG. 12 a schematic view of the detection scheme of a user movement.

FIG. 12 shows a schematic view of the detection scheme of a user movement. The frontal plane 420 is the dashed line seen, before a movement of a person 410. The person 410 advances and turns right. Therefore the frontal pelvis plane 423 of the person in inclined to the right and is in front of the previous frontal plane, so that the back gliding of pulley 312 by an amount of m2 is smaller than the forward movement of pulley 311 by an amount of m1. The amount of the movements m1 and m2 depend on the width w of the person.

Figure 13:
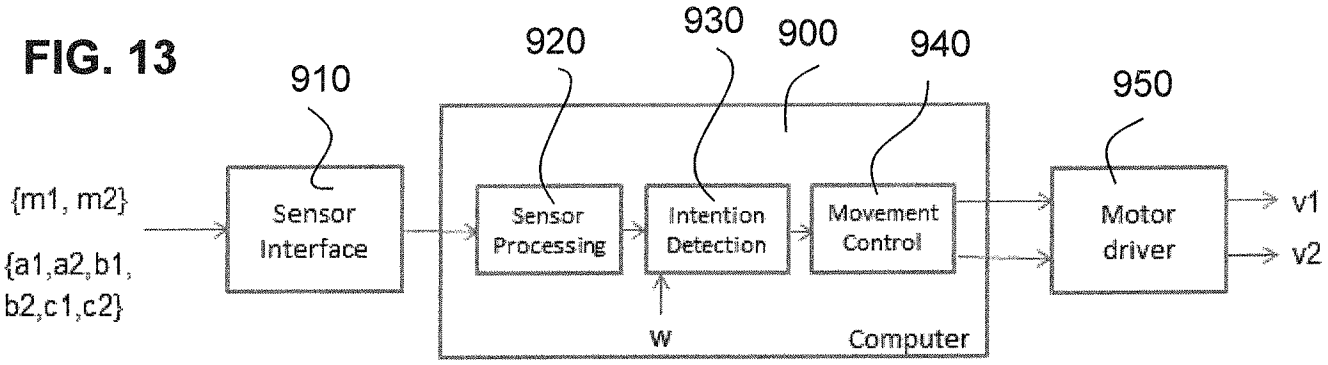
FIG. 13 a diagram of the control unit of an apparatus according to the invention.

FIG. 13 shows a diagram of the control unit 900 of an apparatus according to the invention. The sensor interface 910 is connected with the different sensors as mentioned above. This can include the position sensors of the rails or angular sensors for the pulley orientation or the length of the stretch sensors. The sensor input 910 is processed within the control unit in a sensor processing stage 920 and handed over to the intention detection 930, where input relating to the person 410 as the body width w is used to provide a control signal to generate in the movement control section 940 a drive signal to the motor drive unit 950 which drives the elements 210 and generate a speed v1 and v2 for the different driven wheels 211 and 212 which then rotates the apparatus 100 according to the intention of the person 410 in the harness 500. In an embodiment comprising an orthosis 700, e.g. according to FIG. 3, it is possible to provide the traverse position information of the cuffs 711, 712 on their telescopic rod-sleeve connections or guiding rails as well as input to sensor interface 910.

Figure 14:
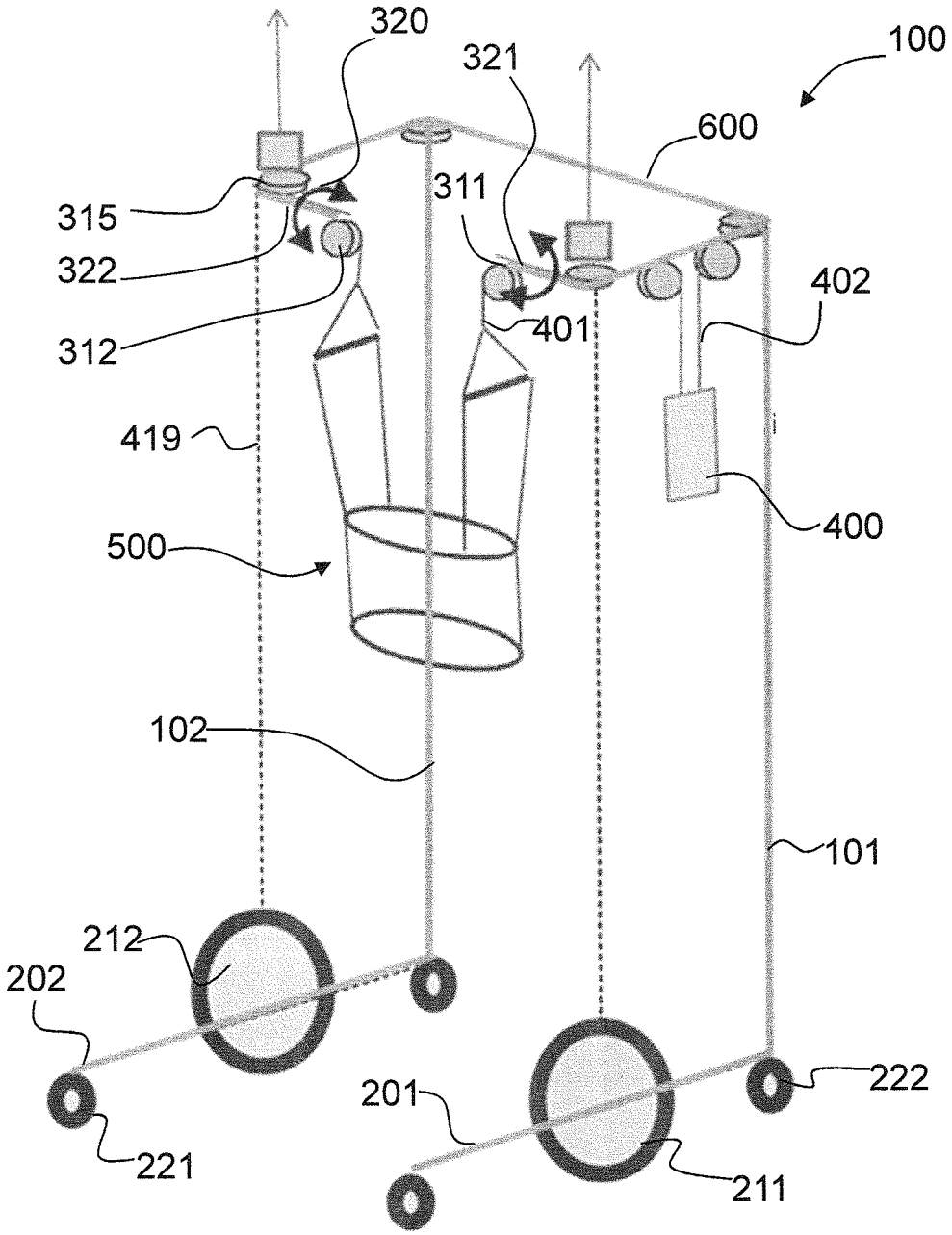
FIG. 14 shows a schematic diagram of an apparatus for gait training depicting another arrangement of the frame and ropes in connection with a weight relief mechanism according to another embodiment of the invention.

FIG. 14 shows a schematic diagram of an apparatus 100 for gait training depicting an arrangement of the frame and ropes in connection with a weight relief mechanism 400 according to a further embodiment of the invention. Here, the frame parts are shown with one single crossbeam 600 and two transverse side arms 321 and 322, wherein rope 402 is redirected via the crossbeam 600 as in FIG. 6 to the single weight relief mechanism 400. Pulleys 311 and 312 can in one embodiment being attached at the side arms 321 and 322 which can be pivoted freely and independently relative to the arrangement 300 according to the double arrows 320, such that when the person 410 moves, the transverse side arms 321 and 322 rotate independently around this horizontal axis due to the force acting on the ropes 401 and 402, wherein such rotations are measurable, e.g. by angular sensors like potentiometers, and providing input to the control unit 900.

In such an embodiment the pulleys 311 and 312 for directing the ropes towards the user can be rotatably attached at the free ends of the transverse side arms 321 and 322 and then the pulleys 311 and 312 rotate according to the double arrows 320.

Figure 15:
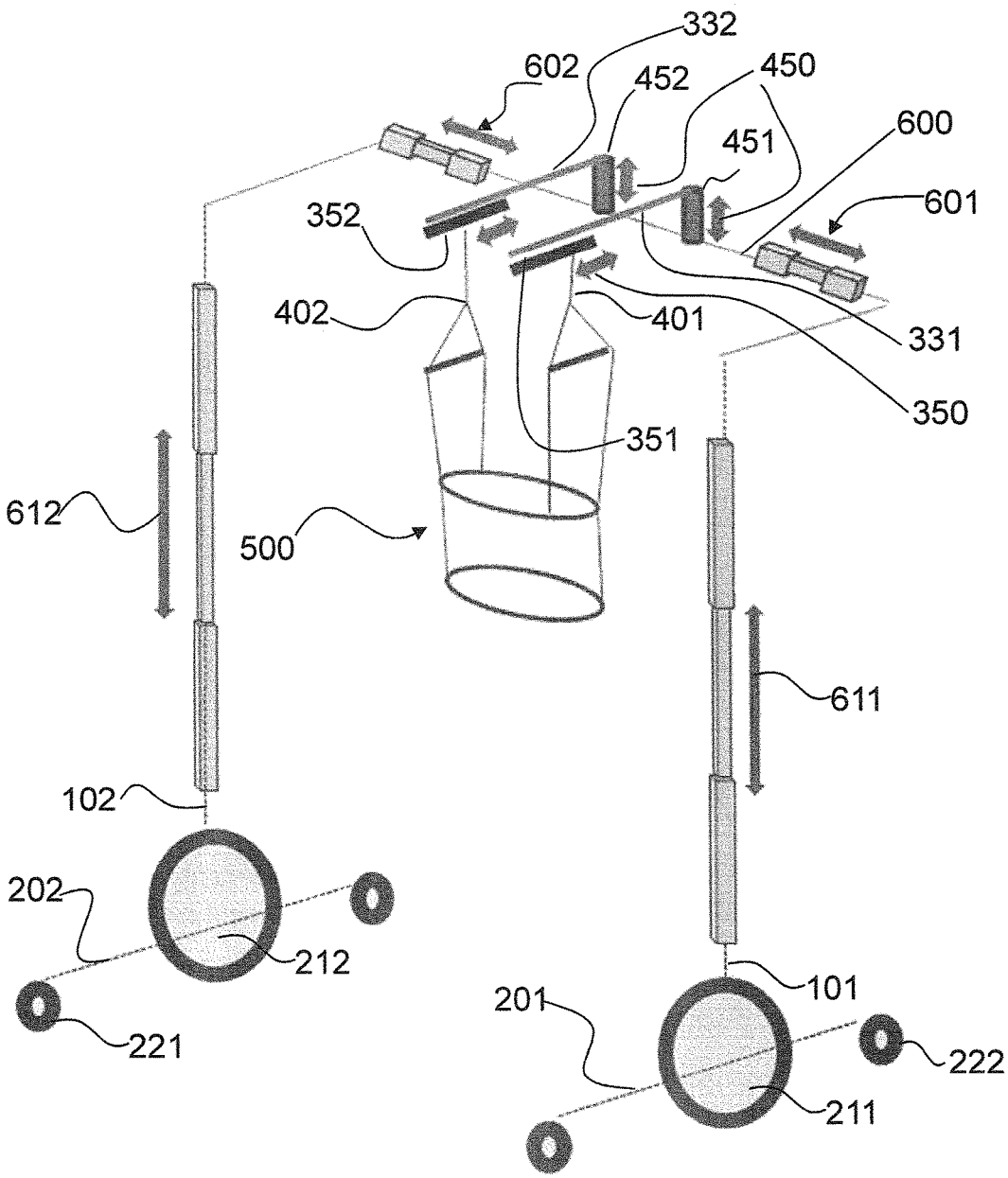
FIG. 15 shows a schematic diagram of an apparatus for gait training depicting another arrangement of the frame and ropes in connection with a weight relief mechanism according to another embodiment of the invention in which the telescoping mechanism is used to lift the person and adapt to the height of the person.

FIG. 15 shows a schematic diagram of an apparatus for gait training depicting another arrangement of the frame and ropes in connection with a weight relief mechanism according to another embodiment of the invention, in which the telescoping mechanism is used similar to the embodiment of FIG. 10 to lift the person and adapt to the height of the person. The telescoping connections 611 and 612 are preferably integrated in the columns 101 and 102 and allow for a height adjustment of the harness attachment portion. This apparatus according to FIG. 15 now allows the separation of the adjustment of the length of the ropes from the dynamic weight relief which was usually combined in the apparatus as mentioned in the prior art.

Here the side arms 331 and 332 are attached at weight relief columns 451 and 452, respectively, which are in turn fixedly provided on the crossbeam 600. The weight relief columns 451 and 452 can comprise a spring actioned device working according to double arrow 450 allowing an independent and essentially vertical movement of the side arms 331 and 332, preferably in a range of up to 15 centimetres, because such an extent is the maximum usual difference of the height of a torso above ground while walking through an entire step. This e.g. simple spring attachment of the side arms 331 and 332 then relates to the dynamic weight relief. The ropes 401 and 402 of a predefined, optionally mechanically adjustable, length are attached at the guiding rails 351 and 352 which are in turn attached at the side arms 331 and 332, respectively.

Additionally the crossbeam 600 is sectioned as already explained in connection with FIG. 10 allowing for a width adjustment of the device, i.e. defining the transverse distance of base column 201 and 202 and thus the available free space between wheels 211 and 212 for walking.

It is also possible that the columns 451 and 452 are fixed rods and the side arms 331 and 332 are pivotably connected to them to rotate around a horizontal axis parallel to crossbeam 600. Then the length adjustment of the ropes 401 and 402, allowing for an up-and-down movement of the guiding rails and attachment points of the rope 401 and 402 depends on the inclination of the side arms 331 and 332.

It is also possible that the columns 451 and 452 are fixed rods and the side arms 331 and 332 are pivotably connected to them to rotate around a vertical axis parallel to each column 451 and 452, respectively. Then the rotation of the side arms 331 and 332 can be detected by an angular sensor and indicate a turning movement of the attached user in harness 500. Here, they pivot in the horizontal plane on both sides of the head of the person in the apparatus. Of course, it is possible to combine this with spring actuated columns 451 and 452 or pivotable side arms 331 and 332 as mentioned before, both solutions being related to a dynamic weight relief.

The adjustment of the rope length, inter alia to adjust the apparatus for different sized persons to use it, is provided by the telescoping arrangement of the vertical columns 101 and 102. This can be motorized, using a worm which is actuated by a driving wheel or other mechanisms to raise or lower the upper crossbeam arrangement over ground.

The weight support system incorporated in columns 451 and 452 or through pivotable arms 331 and 332 allows for a vertical movement portion at least of the free ends of arms 331 and 332 and applies forces to these arms 331 and 332 via the weight support components in order to provide the at least partial unloading of the person. The weight support components may be springs in columns 451 and 452. In another embodiment the weight support components may be more elaborate mechanisms that provide essentially constant unloading over the vertical movement range of arms 331 and 332 in direction of double arrows 450, e.g. similar to the mechanical compensation scheme as developed by the applicant in EP 1 908 442 A1.

It is noted that the direct attachment of ropes 401 and 402 to the side arms is also possible in connection with the embodiments of FIGS. 1 to 14. Then the pulleys 311 and 312 (and subsequent rope redirection and weight relief apparatus 400 is replaced by the suspension elements as mentioned in connection with the description of FIG. 15.

Figure 16:
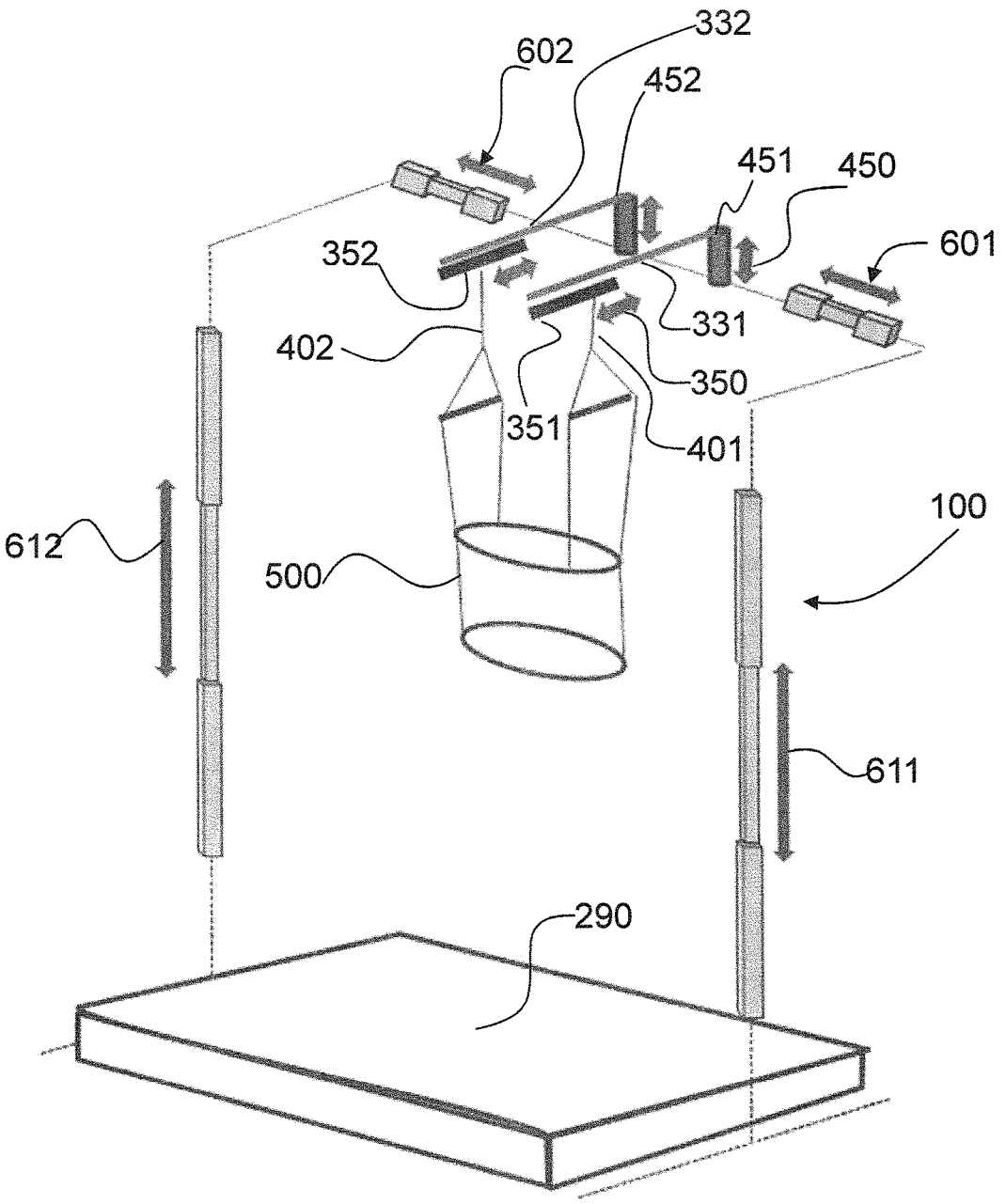
FIG. 16 shows a schematic diagram of an apparatus for gait training depicting another arrangement of the frame and ropes in connection with a weight relief mechanism according to another embodiment of the invention, wherein the apparatus is placed over a treadmill.

FIG. 16 shows a schematic diagram of an apparatus for gait training depicting another arrangement of the frame and ropes in connection with a weight relief mechanism according to another embodiment of the invention, wherein the apparatus 100 is placed over a treadmill 290. In fact, FIG. 16 shows a schematic diagram of the "upper" components of an apparatus 100 for gait training that is placed over a treadmill 290 as fixed basis. As this allows for gait training without moving around, the drive units are not used for moving the apparatus around, but instead drive the treadmill belt, not specifically shown but integrated into the upper surface of basis frame element with the reference numeral 290.

It is noted that all embodiments from FIG. 1 to FIG. 11 are applicable with the movable base as well as with a fixed base 290, e.g. mounted above a treadmill.

Figure 17:
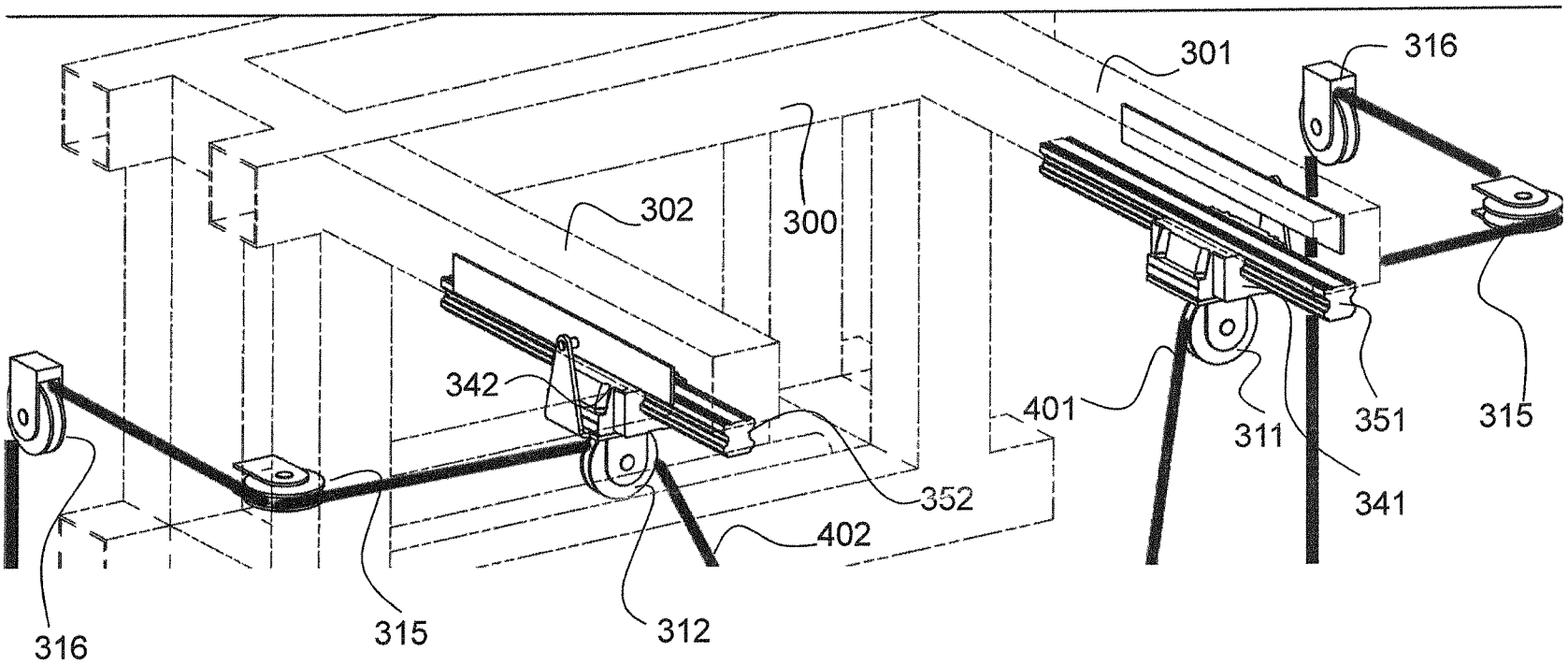
FIG. 17 shows a detail view of the beam arrangement of the embodiments of FIGS. 1 to 5.

FIG. 17 shows a detail view of the beam arrangement of the embodiments of FIGS. 1 to 5. There the longitudinal position of the carriages 341 and 342 on the guiding rails 351 and 352 is detected with position sensors for the carriages 341 and 342 to determine the intention of the user in the harness 500. An acceleration of the movement forward is translated by a gliding of the carriages 341 and 342 towards the free ends of side arms 301 and 302. When the user is stopping his walking, then the opposite movement can be detected. When the user is turning to its right (in walking direction) then the left carriage 341 is moving towards the free end of side arm 301 whereas the right carriage 342 stays or advances backward.

Figure 18:
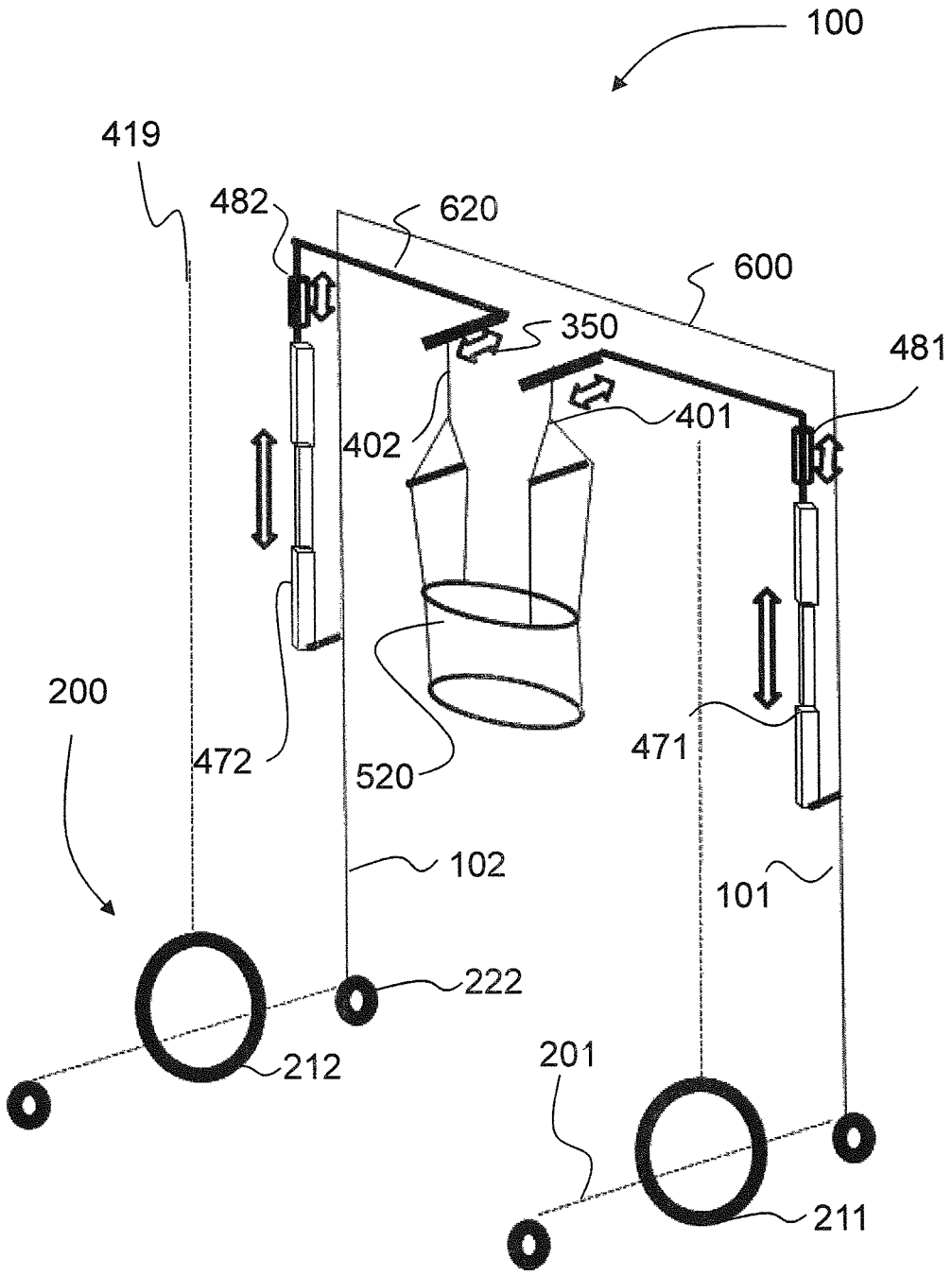
FIG. 18 shows a schematic diagram of an apparatus for gait training depicting an arrangement of a different fixed size frame and ropes in connection with a weight relief mechanism according to a further embodiment of the invention.

FIG. 18 shows a schematic diagram of an apparatus for gait training depicting an arrangement of a different fixed-size frame and ropes in connection with a weight relief mechanism according to a further embodiment of the invention. As in other embodiments, the apparatus 100 has a frame comprising a left column 101 and a right column 102 connected together in the upper part of the frame through a crossbeam 600 connecting the two columns 101 and 102 in a predetermined distance one from the other creating the space for accommodating the person 410 to be located in between. One difference between this embodiment and other embodiments is the fixed frame with fixed length columns 101 and 102 attached at the movable base 200, here at the rear support wheels 222 and a fixed length crossbeam 600. The dimensions of the frame are preferably chosen to be able to pass through the usual door frames.

In other words, the frame according to this embodiment is fixed and has no telescoping elements for adjustment of height or width. The adjustment for the patient's height and supporting lifting are done by linear drives 471 and 472 attached directly or indirectly at the columns 101 and 102, respectively, for moving the left and right weight support units 481 and 482, respectively, up and down. Similarly to the weight relief columns 451 and 452 in the embodiment depicted in FIG. 15, the weight support units 481 and 482 can comprise a spring actioned device working according to the depicted double arrow allowing an independent and essentially vertical movement of the additional crossbeams 620, preferably in a range of up to 15 centimetres, because such an extent is the usual difference of the height of a torso above ground while walking through an entire step. This e.g. simple spring attachment of the additional crossbeam 620 then relates to the dynamic weight relief. The ropes 401 and 402 of a predefined, optionally mechanically adjustable, length are attached at the guiding rails 351 and 352 which are in turn attached at additional crossbeam 620, respectively.

Additional crossbeam 620 is shown in two parts with the a in arrangement at the inner ends. Double arrow 350 shows the direction of the compensating motion of ropes 401 and 402 in the forward and backward direction along the arm arrangement. It is also possible that the additional crossbeam 620 is one piece extending in parallel to crossbeam 600. It is preferred that vertical oriented linear drives 471 and 472 as well as the weight support units 481 and 482 do not extend beyond the dimensions of columns 101, 102 and crossbeam 600.

Arm arrangement 300 is directed opposite to crossbeam 600 and has a length that, when the ropes 401 and 402 are in a middle position along the arm arrangement 300, the ropes are in the same plane as the vertical line in frontal plane 419, allowing the person walking in the apparatus to be maintained essentially uprightly and in the vicinity of said plane 420.

FIG. 19 shows a schematic diagram of an apparatus for gait training depicting an arrangement of a different fixed-size frame and ropes in connection with a weight relief mechanism according to a further embodiment of the invention, similar to FIG. 18. Similar or identical features have received similar or the same reference numerals. The linear drives 471 and 472 are in parallel to columns 101 and 102, especially in direction of the driven wheels 211 and 212. The difference between the two embodiments of FIG. 18 and FIG. 19 are related to the arrangement of the weight support units 481 and 482 which are provided in parallel to the linear drives but in line with the vertical line in the frontal plane 419, above the driven wheels 211 and 212, respectively. The function of the adjustable columns 451, 452 of FIG. 16 as to provide a lifting function of the user is integrated into the weight support units 481, 482 which do not change the dimensions of the external frame 600. In other words, the weight support units provide the partial weight support over a certain vertical range of positions of the arms 300.

Alternatively, the adjustable columns can be attached to and vertically moved by linear drives or telescoping elements 611, 612 for adjustment to the patient's height and lifting, while the left and right column 101, 102 are fixedly connected by the crossbeam 600. The apparatus can apply three or more crossbeams 600 such that this apparatus comprises one crossbeam that connects the left and right column 101,102, two half crossbeams that are connected to the left column via the first telescoping connection 611 or the right column 102 via the second telescoping connection 612 respectively, the telescoping connections being configured to vertically move said half crossbeams, wherein either the left and right adjustable columns 481, 482 are attached to one of said half crossbeams 620, or the left adjustable column 481 and to which the side arm 331 which provides the guiding rail 351 is attached to the left half crossbeam and vice versa.

LIST OF REFERENCE SIGNS

| | |
|---|---|
| 100 | apparatus |
| 101 | left column |
| 102 | right column |
| 200 | movable base |
| 201 | left base |
| 202 | right base |
| 210 | drive unit |
| 211 | left driven wheel |
| 212 | right driven wheel |
| 215 | driven wheel axis |
| 221 | support wheel |
| 222 | support wheel |
| 290 | treadmill basis/fix basis |
| 300 | arm arrangement |
| 301 | left side arm |
| 302 | right side arm |
| 311 | pulley |
| 312 | pulley |
| 315 | pulley |
| 316 | pulley |
| 317 | pulley |
| 320 | rotation/double arrow |
| 321 | left side transverse arm |
| 322 | right side transverse arm |

-continued

| LIST OF REFERENCE SIGNS | |
|---|---|
| 331 | left side pivotable arm |
| 332 | right side pivotable arm |
| 341 | left carriage |
| 342 | right carriage |
| 350 | translation double arrow |
| 351 | left guiding rail |
| 352 | right guiding rail |
| 353 | single guiding rail |
| 400 | weight support system |
| 401 | rope |
| 402 | rope |
| 403 | single rope |
| 410 | person |
| 411 | head of the person |
| 412 | shoulder |
| 413 | torso |
| 416 | left arm |
| 417 | right arm |
| 419 | vertical line in frontal plane |
| 420 | frontal plane |
| 421 | left leg |
| 422 | right leg |
| 423 | pelvis plane |
| 426 | front rope part |
| 427 | back rope part |
| 428 | distance rod |
| 429 | transverse rod |
| 450 | weight suspension double arrow |
| 451 | left adjustment column |
| 452 | right adjustment column |
| 471 | linear drive |
| 472 | linear drive |
| 481 | left weight support unit |
| 482 | right weight support unit |
| 500 | harness |
| 501 | attachment point |
| 502 | attachment point |
| 510 | upper part |
| 520 | pelvis part |
| 521 | crotch strap |
| 531 | stretch sensor |
| 532 | stretch sensor |
| 533 | load bearing connection |
| 600 | crossbeam |
| 601 | first telescoping connection |
| 602 | second telescoping connection |
| 610 | adjustment wheel |
| 611 | first telescoping connection |
| 612 | second telescoping connection |
| 620 | additional crossbeam |
| 700 | orthosis |
| 701 | left leg orthosis |
| 702 | right left orthosis |
| 710 | leg frame |
| 711 | cuff |
| 712 | cuff |
| 715 | inner rod |
| 716 | sleeve |
| 720 | double arrow |
| 801 | linear sensor |
| 802 | linear sensor |
| 810 | wire |
| 811 | angular sensor |
| 812 | angular sensor |
| 900 | control unit |
| 910 | sensor unit |
| 920 | sensor processing unit |
| 930 | intention detection unit |
| 940 | movement control unit |
| 950 | motor drive unit |

The invention claimed is:

1. An apparatus for gait training, the apparatus comprising:

a movable base comprising a left movable base and a right movable base, a left drive unit for moving the left movable base, a right drive unit for moving the right movable base, an arm arrangement extending from the movable base, a harness connected to the arm arrangement with a first strap or rope, a weight support system provided at the movable base to enable a person to be at least partially suspended from above via said arm arrangement and the harness, a movement detector to detect a movement of the person in a movement direction, and a control unit adapted to control the left drive unit and the right drive unit in response to a movement of the person detected by the movement detector, wherein the control unit is adapted to control the left drive unit and the right drive unit such that the movable base follows the person in a predetermined distance range and in a predetermined angular range with respect to the movement direction of the person, wherein the arm arrangement comprises two side arms reaching into a plane extending from a common axis of the left drive unit and the right drive unit for providing the harness in a vicinity of said plane below the side arms, wherein said plane is essentially oriented uprightly, wherein the left drive unit and the right drive unit are arranged with the harness centrally provided in the plane of the left drive unit and the right drive unit, and wherein the control unit is adapted to control the left drive unit and the right drive unit to change the angular orientation of the movable base so that the person's body angle respective to said plane is zero.

2. The apparatus according to claim 1, wherein the first strap or rope configured to suspend the person is attached at the harness, and wherein the movement detector comprises a linear or angular sensor sensing the position or angle of the rope connected with the harness.

3. The apparatus according to claim 1, wherein the side arms are arranged at a height that the head of the person can be positioned between these side arms.

4. The apparatus according to claim 1, wherein the apparatus further comprises a second strap or rope, wherein the first strap or rope and the second strap or rope are attached at the harness at a pelvis harness part.

5. The apparatus according to claim 4, wherein the harness comprises crotch straps for a direct transmission of a turning movement of the person onto the first strap or rope and the second strap or rope.

6. The apparatus according to claim 4, wherein each of the first strap or rope and the second strap or rope are separated into a front and a back rope section separated by a distance rod above the shoulder of the person, wherein the front and the back rope sections are attached at the harness in front and in the back of the person.

7. The apparatus according to claim 1, wherein a left leg orthosis and a right leg orthosis are provided and attached to the left and right movable base of the apparatus, respectively, wherein the orthoses comprise cuffs which are configured to be moved in the direction of said plane.

8. The apparatus according to claim 7, wherein the cuffs are mounted on a telescopic element connected with the left leg orthosis and the right leg orthosis.

9. The apparatus according to claim 1, wherein the harness comprises an upper part and a lower part, wherein the upper part is connected to the lower part with at least one stretch sensor for a measurement of the pelvis orientation of the person in relation to the shoulder orientation of the person.

10. The apparatus according to claim 1, wherein the first strap or rope configured to suspend the person is attached at the harness, and wherein the movement detector comprises a linear or angular sensor sensing the position or angle of a further rope provided under tension for said angular deflection measurement.

11. An apparatus for gait training, the apparatus comprising:

a movable base comprising a left movable base and a right movable base, a left drive unit for moving the left movable base, a right drive unit for moving the right movable base, an arm arrangement extending from the movable base, a harness connected to the arm arrangement with a first strap or rope, a weight support system provided at the movable base to enable a person to be at least partially suspended from above via said arm arrangement and the harness, a movement detector to detect a movement of the person in a movement direction, and a control unit adapted to control the left drive unit and the right drive unit in response to a movement of the person detected by the movement detector, wherein the control unit is adapted to control the left drive unit and the right drive unit such that the movable base follows the person in a predetermined distance range and in a predetermined angular range with respect to the movement direction of the person, wherein the arm arrangement comprises two side arms reaching into a plane extending from a common axis of the left drive unit and the right drive unit for providing the harness in a vicinity of said plane below the side arms, wherein said plane is essentially oriented uprightly, wherein the connection between the movable base and the arm arrangement comprises a telescoping arrangement for at least one extension selected from the group consisting of a vertical extension and a horizontal extension.

12. The apparatus according to claim 11, wherein the two side arms comprises a left side arm and a right side arm, wherein the telescoping arrangement comprises a first telescoping connection provided between the left movable base and the left side arm and a second telescoping connection is provided between the right movable base and the right side arm to arrange the left movable base as well as the right movable base in a predetermined horizontal distance from one another.

13. An apparatus for gait training, the apparatus comprising:

a movable base comprising a left movable base and a right movable base, a left drive unit for moving the left movable base, a right drive unit for moving the right movable base, an arm arrangement extending from the movable base, a harness connected to the arm arrangement with a first strap or rope, a weight support system provided at the movable base to enable a person to be at least partially suspended from above via said arm arrangement and the harness, a movement detector to detect a movement of the person in a movement direction, and a control unit adapted to control the left drive unit and the right drive unit in response to a movement of the person detected by the movement detector, wherein the control unit is adapted to control the left drive unit and the right drive unit such that the movable base follows the person in a predetermined distance range and in a predetermined angular range with respect to the movement direction of the person, wherein the arm arrangement comprises two side arms reaching into a plane extending from a common axis of the left drive unit and the right drive unit for providing the harness in a vicinity of said plane below the side arms, wherein said plane is essentially oriented uprightly, wherein the apparatus further comprises a second strap or rope, wherein the first strap or rope and the second strap or rope are arranged between pulleys at the side arms and two points at the sides of the harness above shoulder parts of the harness, and wherein the pulleys are configured to freely move in the direction of the sidearms for detection of a turning movement of the person.

14. An apparatus for gait training, the apparatus comprising:

a movable base comprising a left movable base and a right movable base, a left drive unit for moving the left movable base, a right drive unit for moving the right movable base, an arm arrangement extending from the movable base, a harness connected to the arm arrangement with a first strap or rope, a weight support system provided at the movable base to enable a person to be at least partially suspended from above via said arm arrangement and the harness, a movement detector to detect a movement of the person in a movement direction, and a control unit adapted to control the left drive unit and the right drive unit in response to a movement of the person detected by the movement detector, wherein the control unit is adapted to control the left drive unit and the right drive unit such that the movable base follows the person in a predetermined distance range and in a predetermined angular range with respect to the movement direction of the person, wherein the arm arrangement comprises two side arms reaching into a plane extending from a common axis of the left drive unit and the right drive unit for providing the harness in a vicinity of said plane below the side arms, wherein said plane is essentially oriented uprightly, wherein the apparatus further comprises a second strap or rope, wherein the first strap or rope and the second strap or rope are arranged between pulleys at the side arms and two points at the sides of the harness above shoulder parts of the harness, and wherein the side arms are configured to either pivot freely around a vertical axis or rotate freely around a horizontal axis and independently relative to the arm arrangement for detection of a turning movement of the person.

15. An apparatus for gait training, the apparatus comprising:

a movable base comprising a left movable base and a right movable base, a left drive unit for moving the left movable base, a right drive unit for moving the right movable base, an arm arrangement extending from the movable base, a harness connected to the arm arrangement with a first strap or rope, a weight support system provided at the movable base to enable a person to be at least partially suspended from above via said arm arrangement and the harness, a movement detector to detect a movement of the person in a movement direction, and a control unit adapted to control the left drive unit and the right drive unit in response to a movement of the person detected by the movement detector, wherein the control unit is adapted to control the left drive unit and the right drive unit such that the movable base follows the person in a predetermined distance range and in a predetermined angular range with respect to the movement direction of the person, wherein the arm arrangement comprises two side arms reaching into a plane extending from a common axis of the left drive unit and the right drive unit for providing the harness in a vicinity of said plane below the side arms, wherein said plane is essentially oriented uprightly, wherein the apparatus further comprises a second strap or rope, wherein the first strap or rope and the second strap or rope are attached directly or via longitudinally displaceable guiding rails at the side arms, whereas at least the attachment points of the first strap or rope and the second strap or rope are mounted displaceably in the vertical direction for a predetermined amount relative to the weight support system, being a vertical spring attachment of the side arms with the crossbeam or a pivotable attachment of the side arms around a transverse horizontal axis.

* * * * *